US007650871B2

(12) United States Patent
See

(10) Patent No.: US 7,650,871 B2
(45) Date of Patent: Jan. 26, 2010

(54) ROTARY COMPRESSOR AND EXPANDER, AND ROTARY ENGINE USING THE SAME

(75) Inventor: Richard See, Kent (GB)

(73) Assignee: Turnstile Technology Limited, Kent (GB)

( * ) Notice: Subject to any disclaimer, the term of this patent is extended or adjusted under 35 U.S.C. 154(b) by 372 days.

(21) Appl. No.: 10/561,369

(22) PCT Filed: Jun. 15, 2004

(86) PCT No.: PCT/GB2004/002483

§ 371 (c)(1),
(2), (4) Date: Feb. 12, 2007

(87) PCT Pub. No.: WO2004/113683

PCT Pub. Date: Dec. 29, 2004

(65) Prior Publication Data

US 2007/0175435 A1 Aug. 2, 2007

(30) Foreign Application Priority Data

Jun. 17, 2003 (GB) ..... 0314035.7

(51) Int. Cl.

| | |
|---|---|
| ***F02B 53/04*** | (2006.01) |
| ***F02B 53/00*** | (2006.01) |
| ***F02B 53/02*** | (2006.01) |
| ***F01C 1/00*** | (2006.01) |
| ***F01C 1/08*** | (2006.01) |
| ***F04C 2/00*** | (2006.01) |
| ***F04C 18/00*** | (2006.01) |
| ***F01C 3/02*** | (2006.01) |

(52) U.S. Cl. ..... 123/223; 123/233; 123/229; 418/195; 418/196

(58) Field of Classification Search ..... 123/228–229, 123/233, 206, 221, 238; 418/195–196; *F01C 3/02, F01C 1/00; F02B 53/00, 53/02*
See application file for complete search history.

(56) References Cited

U.S. PATENT DOCUMENTS 889,439 A * 6/1908 Carter ..... 418/195

(Continued)

FOREIGN PATENT DOCUMENTS

DE 320038 C 5/1920

(Continued)

*Primary Examiner*—Thai Ba Trieu
(74) *Attorney, Agent, or Firm*—Blakely, Sokoloff, Taylor & Zafman

(57) ABSTRACT

A rotary device for use with compressible fluids comprises a first rotation element mounted to rotate about a first axis and a casing having a surface enclosing at least a part of the first rotation element. An elongate cavity of varying cross sectional area is defined between a surface of the first rotation element and the casing surface. The rotary device also comprises a number of second rotation elements mounted to rotate about respective second axes. Each second rotation element is mounted to project through the casing surface and cooperate with the first rotation element surface to divide the cavity into adjacent working portions. At least one on the Working portions defines a closed volume for a part of a cycle of the device. As the first and second rotation elements rotate, the volumes of the working portions vary. Each second rotation element comprises a number of projecting portions of varying radius about the respective second axis such that each projecting portion projects through the casing into the cavity by a varying amount to cooperate with the first rotation element surface.

13 Claims, 24 Drawing Sheets

U.S. PATENT DOCUMENTS

| | | | | | |
|---|---|---|---|---|---|
| 1,012,616 | A | * | 12/1911 | Dubus | 418/195 |
| 1,106,666 | A | * | 8/1914 | Miller | 123/233 |
| 1,305,133 | A | * | 5/1919 | Little | 418/195 |
| 2,674,982 | A | * | 4/1954 | Mccall | 123/221 |
| 3,012,551 | A | | 12/1961 | Renshaw | 418/195 |
| 3,060,910 | A | | 10/1962 | McCall | 418/195 |
| 3,205,874 | A | | 9/1965 | Renshaw | 418/195 |
| 3,208,437 | A | | 9/1965 | Coulter | 418/195 |
| 3,214,907 | A | * | 11/1965 | Erich | 123/249 |
| 3,221,717 | A | | 12/1965 | Renshaw | 418/195 |
| 3,277,832 | A | * | 10/1966 | Louis | 418/195 |
| 3,502,054 | A | * | 3/1970 | Hambric | 123/221 |
| 3,632,239 | A | | 1/1972 | Zimmern | 418/195 |
| 3,726,616 | A | * | 4/1973 | Powers | 418/195 |
| 3,739,754 | A | * | 6/1973 | Nutku | 123/229 |
| 3,862,623 | A | | 1/1975 | Ehlert | 418/195 |
| 3,897,756 | A | | 8/1975 | Upchurch | 418/195 |
| 4,005,682 | A | | 2/1977 | McCall et al. | 418/195 |
| 4,013,046 | A | * | 3/1977 | Kemp | 123/229 |
| 4,558,669 | A | | 12/1985 | Kemp | 123/233 |
| 6,119,649 | A | * | 9/2000 | Raab | 123/233 |
| 6,257,195 | B1 | | 7/2001 | Vanmoor | 123/239 |
| 6,276,329 | B1 | * | 8/2001 | Archer | 123/228 |
| 6,546,908 | B1 | * | 4/2003 | Pekau | 123/206 |
| 6,588,395 | B2 | * | 7/2003 | DeFazio | 123/223 |
| 7,059,294 | B2 | * | 6/2006 | Wright | 123/233 |

FOREIGN PATENT DOCUMENTS

| | | | | |
|---|---|---|---|---|
| DE | 2827211 | A | * | 1/1980 |
| DE | 3041606 | A | * | 6/1982 |
| DE | 3301726 | A1 | * | 7/1984 |
| DE | 4127870 | A1 | * | 1/1992 |
| DE | 4226063 | A1 | * | 1/1994 |
| DE | 4323345 | A1 | * | 1/1995 |
| DE | 19509913 | A1 | * | 9/1996 |
| DE | 10354621 | A1 | * | 6/2005 |
| EP | 933500 | A1 | * | 8/1999 |
| FR | 1 600 666 | A | | 7/1970 |
| FR | 2531744 | A | * | 2/1984 |
| GB | 653185 | | | 5/1948 |
| GB | 1068067 | A | | 5/1967 |
| GB | 1364638 | A | | 8/1974 |
| GB | 1376908 | A | * | 12/1974 |
| GB | 2356896 | A | * | 6/2001 |
| GB | 2374903 | A | * | 10/2002 |
| JP | 54087911 | A | * | 7/1979 |
| JP | 63227901 | A | * | 9/1988 |
| JP | 63295818 | A | * | 12/1988 |
| JP | 03100328 | A | * | 4/1991 |
| JP | 04101021 | A | * | 4/1992 |
| RU | 2044893 | C1 | * | 9/1995 |
| SU | 1830600 | A1 | * | 7/1993 |
| WO | WO 9314299 | A1 | * | 7/1993 |
| WO | WO 9635507 | A1 | * | 11/1996 |
| WO | WO 9743519 | A1 | * | 11/1997 |
| WO | WO 0012867 | A1 | * | 3/2000 |

* cited by examiner

ROTARY COMPRESSOR AND EXPANDER, AND ROTARY ENGINE USING THE SAME

The present patent application is a non-provisional application of International Application No. PCT/GB2004/002483, filed Jun. 15, 2004.

This invention relates to devices used for the compression or expansion of elastic fluids. More particularly, but not exclusively, this invention relates to rotary devices used for the compression or expansion of gases, and rotary engines comprising such devices.

The compression or expansion of gases occurs in a large variety of devices. Well known examples include pumps, compressors, blowers, exhausters, and rotary and hydraulic engines, all of which include some form of apparatus used to compress or expand gases. This invention encompasses all such devices.

As mentioned above, compressors are well known devices. One type of compressor is the reciprocating compressor. Reciprocating compressors have the advantage that they are able to operate at high pressures. However, reciprocating compressors have a large number of moving parts and are therefore relatively complex devices. One other type of compressor, the Roots compressor, has rotary instead of reciprocating motion and its resulting simplicity means that it has few moving parts and is reliable. Nevertheless, this type of compressor has its disadvantages. One such disadvantage is that it relies on "back-compression" to raise the pressure of the pumped gases. This means that no compression is performed on the low pressure input gases until they come into contact and mix with the higher pressure gases within the compressor. This irreversible process is inefficient, and leads to a higher drive power requirement and elevated air outlet temperatures.

Another type of rotary compressor, the Lysholm compressor, employs internal compression to overcome the problems caused by "back compression". Typically, these compressors are significantly more efficient. However, their performance depends in large measure upon maintaining very small clearances between the moving elements, thus presenting considerable manufacturing problems. Imperfect sealing between the elements leads to back-leakage of the gas, limiting the pressures that can be attained using a single compressor.

Compressors of the types discussed above are used in internal combustion engines. In particular, rotary compressors of the Roots, single-screw or Lysholm type are used in rotary engines, together with a corresponding expander mechanism that allows work to be extracted during expansion of the hot, pressurised gases. Rotary engines, like rotary compressors, can have fewer moving parts and are thus more reliable than their reciprocating equivalents. Production and maintenance costs are also potentially lower. Typically, rotary engines are also less noisy and can achieve more combustion cycles per second compared to reciprocating engines, thus leading to a superior power to weight ratio.

The idealised cycle that most rotary internal combustion engines approximate is the Otto cycle. One disadvantage of the Otto cycle is that the amount of work that can be extracted from the hot, pressurised gases is limited because the expansion ratio of the engine cannot exceed its compression ratio. The gases at the end of the Otto cycle's isentropic expansion step could do more work if further expansion to ambient pressure was allowed. This disadvantage is overcome in the idealised cycle known as the Atkinson-Miller cycle. The Atkinson-Miller cycle allows isentropic expansion to ambient pressure, and thus compression and expansion ratios that can be different. A number of rotary internal combustion engines using the Atkinson-Miller cycle have been proposed. However, these engine designs typically have many moving parts, or use parts that are difficult to manufacture. Advantageous rotary engine designs are capable of high compression ratios so that they may be used in compression ignition engines such as diesel engines. The power output of a rotary engine should be smooth and continuous, with minimal vibration. Noise and mechanical wear should be minimal.

Various single screw rotary engines are well known in which compression and expansion occur in helical shaped channels which are formed in the surface a rotatable block. Separate working chambers are defined by the helical channel, a surface surrounding the rotatable block which seals the helical channel, and wheels having teeth or vanes which mesh with the helical channel. For example, GB653185 discloses a rotary engine in which compression and expansion are achieved by providing a helical channel of varying depth and in which varying fractions of the wheel teeth or vanes define the working chambers. In the engine of GB653185, the tip of a tooth or vane remains within the channel, and the tooth or vane is always in contact with the gas in the working chamber. Additionally, the shape of the wheel teeth or vanes does not significantly affect the compression or expansion ratio of the engine, and compression and expansion are performed in different parts of the engine:

U.S. Pat. Nos. 3,862,623 and 3,897,756 disclose rotary engines in which a rotatable block only rotates about its axis by a fraction of a revolution during each cycle, and in which compression and expansion occur against the teeth or vanes of a rotating wheel. In these engines, the depth of the channel does not vary, and thus two different working chambers must be used for compression and expansion respectively.

U.S. Pat. Nos. 4,003,348, 4,005,682 and 4,013,046 disclose rotary engines having different compression and expansion ratios. However, in order to control the flow of fuel and air, they have passages of complex form, which present significant manufacturing problems. U.S. Pat. No. 4,013,046 discloses a rotary engine in which valves open and close during each cycle to control the flow of gases.

U.S. Pat. Nos. 2,674,982, 3,208,437, 3,060,910, 3,221,717, and 3,205,874 disclose rotary engines in which the working chambers are defined by intermeshing toothed or vaned wheels. However, in these engines, the working chamber is defined by first one wheel, and then another wheel, so that more than one rotating part needs to be sealed.

According to an aspect of the present invention, there is provided a rotary device for use with compressible fluids, the device comprising a first rotation element mounted to rotate about a first axis and a casing having a surface enclosing at least a part of the first rotation element, an elongate cavity of varying cross sectional area being defined between a surface of the first rotation element and the casing surface, the rotary device further comprising a number of second rotation elements mounted to rotate about respective second axes, each second rotation element being mounted to project through the casing surface and cooperate with the first rotation element surface to divide the cavity into adjacent working portions, at least one working portion defining a closed volume for a part of a cycle of the device, the volumes of the working portions varying as the first and second rotation elements rotate, wherein each second rotation element comprises a number of projecting portions of varying radius about the respective second axis such that each projecting portion projects through the casing into the cavity by a varying amount to cooperate with the first rotation element surface.

The first rotation element and each of the second rotation elements have a variable radius. The casing surface, which has a constant radius, and the first rotation element surface therefore define a cavity that extends around the first axis. As the first rotation element rotates about the first axis, the cavity also rotates about the first axis. Each of the second rotation elements project through the casing surface. As each of the second rotation elements rotate, the amount by which they project through the casing surface varies. In fact, rotation of the first rotation element and each of the second rotation elements is coordinated so that they mesh together to provide a seal. Each of the second rotation elements thus define a number of working portions of the cavity. Working portions may also be defined by the first rotation element where its radius is at a maximum by providing a seal with the casing. As the cavity rotates about the first axis, the volumes of the working portions of the cavity change, thus providing compression or expansion of a fluid within.

A rotary compressor or expander, or a rotary engine using the same, can thus be realised having a number of desirable qualities while at the same time being simple to manufacture and use. The rotary device relies on internal compression thus avoiding the disadvantages associated with 'back compression', such as inefficiency. At the same time, the simplicity of the design allows effective sealing between the various elements of the rotary device thus avoiding the manufacturing complexity and other problems associated with known internal compression rotary devices.

Preferably, the first and second rotation elements each comprise a plurality of integral segments each having different radii.

Preferably, the second rotation elements are distributed around the casing surface, each second rotation element being mounted to rotate about a respective axis that is perpendicular to both the first axis and the radius of the casing surface. In this way, a number of working portions of the cavity can be defined, and a compression and/or expansion process can be performed simultaneously in each.

The first rotation element may be internal to the casing surface with the plurality of second rotation elements being external to the casing surface. In this case, the first rotation element will be substantially cylindrical. Alternatively, the first rotation element may be external to the casing surface with the plurality of second rotation elements being internal to the casing surface. In this case, the first rotation element will substantially take the form of an annulus.

The rotary device may be a rotary compressor or rotary expander. In the case of a compressor, rotation of the first rotation element and each of the plurality of second rotation elements causes the volume of each of the working portions of the cavity to reduce during each cycle. In the case of an expander, rotation of the first rotation element and each of the plurality of second rotation elements causes the volume of each of the working portions of the cavity to increase during each cycle.

The rotary device may be a rotary engine that performs compression followed by expansion. In this case, rotation of the first rotation element and each of the plurality of second rotation elements causes the volume of the working portions of the cavity to reduce and then increase during each cycle. Since compression and expansion are performed by different portions of the first rotation element surface, an engine having different compression and expansion ratios can be realised.

Preferably, the rotary engine also comprises ignition means for ignition of a compressed fluid prior to expansion. For example, the ignition means may comprise a spark plug. In this way, when gases within a working portion of the cavity are at a maximum pressure, a sudden further increase in pressure may be induced. For example, if the gases are a fuel and oxygen mix, a spark plug may induce combustion, as in a conventional petrol engine. Alternatively, if the gases include highly pressurised oxygen, the injection of fuel itself may induce combustion, as in a conventional diesel engine. Other means of causing a sudden further increase in pressure may be used, such as the injection of a small volume of high pressure, low temperature gas. The sudden increase in pressure allows more work to be extracted during expansion than was used in compression, thus powering the engine.

Preferably, the first rotation element also comprises at least one passage for fluid inlet or fluid outlet. The first rotation element may even comprise passages for both fluid inlet and fluid outlet. In this way, fluids can be drawn or forced into the working portions of the cavity, or exhausted or released from the working portions of the cavity.

The casing may also comprise at least one side valve, each of the at least one side valves being operative as a fluid inlet or fluid outlet only when adjacent to a working portion of the cavity, each of the at least one side valves being adjacent to a working portion of the cavity for a fraction of a cycle of the device. The rotary device may therefore be designed so that the area of the casing containing a side valve only forms a boundary of a working portion of the cavity when fluid inlet or fluid outlet is desired.

Preferably, each of the at least one side valves is operative to vary the flow rate of a fluid into a working portion of the cavity, to vary the pressure of fluid within a working portion of the cavity, or to vary a compression or expansion ratio of the rotary device. Side valves may therefore provide a way of controlling the operation of the rotary device.

Preferably, closed loop feedback control is used to control the operation of each of the at least one side valves, the closed loop feedback control being based on an operating parameter such as fluid inlet pressure, fluid outlet pressure and rotary speed. In this way, a number of parameters may be maintained in a steady state.

This invention also provides a rotary device comprising two of the rotary devices described above. In this way, the respective second rotation elements may be arranged so that the net forces on the first rotation element are minimised. For example, this could be achieved by providing a second rotation element from each of the rotary devices on opposite sides of the integral first rotation element.

The invention will now be described by way of example with reference to the following figures in which.

Figure 1:
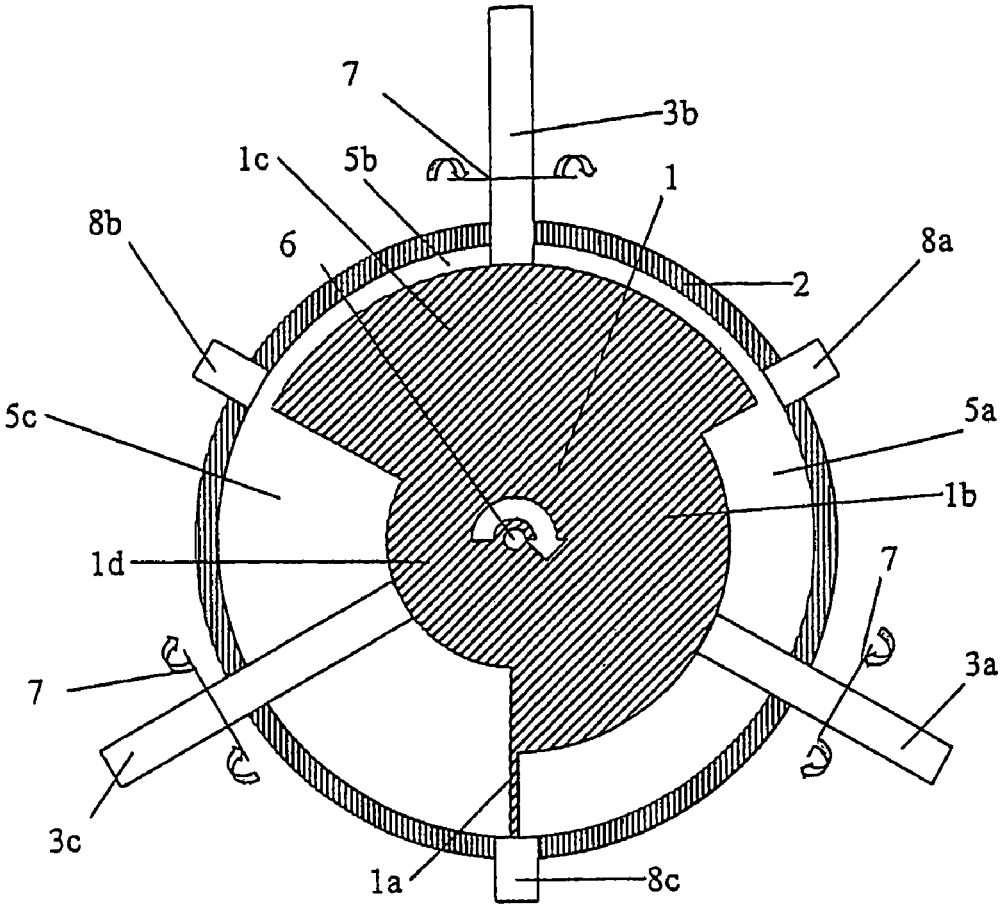
FIGS. 1 and 2 show cross sections of a first rotary engine according to the invention in first and second positions respectively.

It should be noted that all of the figures are schematic and therefore are not to scale. For example, certain dimensions may have been exaggerated in the interests of clarity.

FIGS. 1 to 5 show a first rotary engine according to the invention. The first rotary engine comprises a first rotation element 1, a casing 2, three second rotation elements 3*a*, 3*b*, 3*c*, three spark plugs 8*a*, 8*b*, 8*c* and a power output shaft (not shown).

The first rotation element 1 is mounted to rotate about a first axis 6. The first rotation element 1 is a substantially cylindrical block of material, but having large variations in radius. The first rotation element 1 is made from steel, although those skilled in the art will understand that it may advantageously be made from other materials, Suitable materials for the other described components of the first rotary engine will also be known to those skilled in the art.

The substantially cylindrical first rotation element 1 is essentially formed from four segments each having a different radius: a sealing segment 1*a*, a compression segment 1*b*, a combustion segment 1*c* and an expansion segment 1*d*. The sealing segment 1*a* spans a very small angle about the first axis 6 but has the largest radius. The compression, combustion and expansion segments 1*b*, 1*c*, 1*d* each span slightly less than 120° about the first axis.

During rotation, the sealing segment 1*a* is followed by the compression segment 1*b*, which is followed by the combustion segment 1*c*, which is followed by the expansion segment 1*d*. The radius of the combustion segment 1*c* is slightly less than the radius of the sealing segment 1*a*. The radius of the compression segment 1*b* is less than the combustion segment 1*c*. The radius of the expansion segment 1*d* is less than the compression segment 1*b*. The first rotation element 1 also comprises a fluid inlet passage 4 and a fluid outlet passage 9 adjacent to the sealing segment 1*a*.

The casing 2 includes a substantially cylindrical surface of constant radius centred about the first axis 6 and partially enclosing the first rotation element 1. The casing 2 also has end walls 2*a* that prevent axial movement of the first rotation element 1 along the first axis 6. The end walls 2*a* also provide a seal between the casing 2 and the ends of the first rotation element 1.

A cavity 5*a*, 5*b*, 5*c* is defined between the first rotation element 1 and the casing 2. The cross sectional area of the cavity 5*a*, 5*b*, 5*c* varies around the first axis 6 depending on the radius of the first rotation element 1. For example, the cross sectional area of the cavity is small where it is adjacent to the combustion segment 1*c*, and the cross sectional area of the cavity is large where it is adjacent to the expansion segment 1*d*. There is no cavity adjacent to the sealing segment 1*a* of the first rotation element 1. The sealing segment 1*a* is instead in contact with the casing 2 to provide a seal. The sealing segment 1*a* also forms the beginning and end of the cavity 5*a*, 5*b*, 5*c*. During rotation of the first rotation element 1, the cavity 5*a*, 5*b*, 5*c* also rotates.

The three second rotation elements 3*a*, 3*b*, 3*c* are each mounted around the casing 2 at 120° intervals about the first axis 6. The second rotation elements 3*a*, 3*b*, 3*c* are all mounted at the same axial distance from the ends of the casing 2. The second rotation elements 3*a*, 3*b*, 3*c* are each mounted to rotate about respective axes that are perpendicular to the first axis 6 and a radius of the first rotation element 1. During rotation of the second rotation elements 3*a*, 3*b*, 3*c*, they each project through the casing 2 into the cavity 5*a*, 5*b*, 5*c* by varying amounts. A seal is formed between each of the second rotation elements 3*a*, 3*b*, 3*c* and the casing 2.

Figure 3:
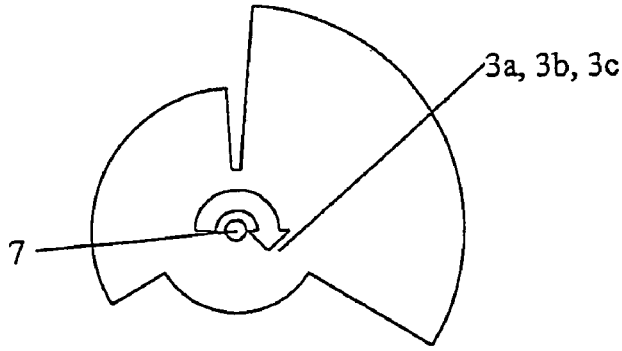
FIG. 3 shows a side profile of a second rotation element of the first rotary engine according to the invention.
Figure 4:
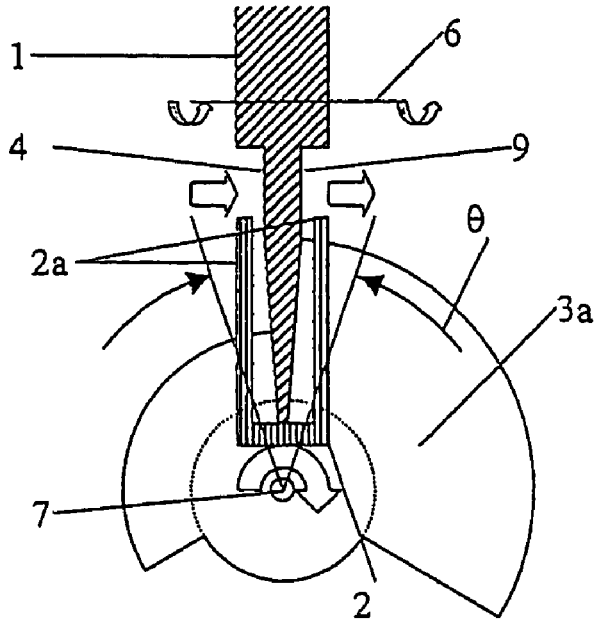
FIGS. 4 and 5 show cross sections of the first rotary engine according to the invention in third and fourth positions.
Figure 5:
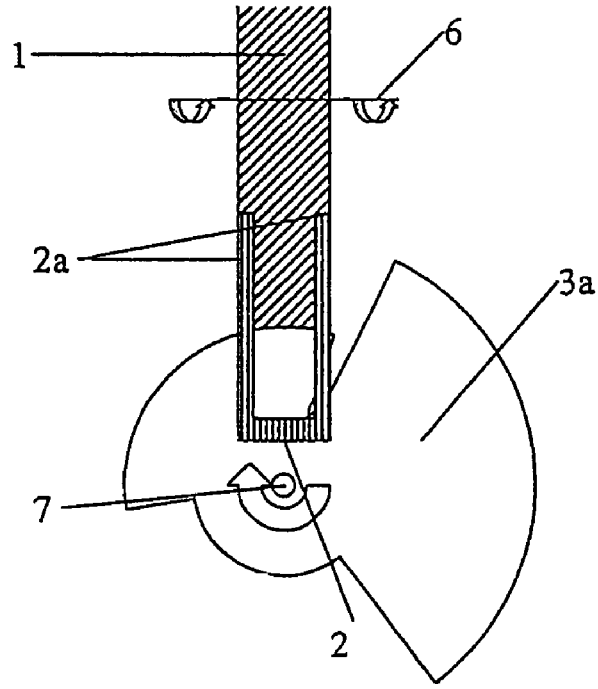

FIG. 3 shows a side profile of one of the second rotation elements 3*a*, 3*b*, 3*c* and the axis 7 about which it rotates. FIGS. 4 and 5 show cross sections of the engine, perpendicular to the axis 7. FIGS. 4 and 5 clearly show the end walls 2*a* of the casing 2, as well as the cylindrical surface. It can be seen from FIG. 3 that, in common with the first rotation element 1, each second rotation element 3*a*, 3*b*, 3*c* is essentially formed from four segments each having a different radius. The radius of each of the segments of the second rotation element 3*a*, 3*b*, 3*c* is designed so that, in operation, each of the segments of each of the second rotation elements co-operate with a different segment 1*a*, 1*b*, 1*c*, 1*d* the first rotation element 1 to provide a seal. The second rotation elements 3*a*, 3*b*, 3*c* therefore define three or four working portions of the cavity.

The second rotation elements 3*a*, 3*b*, 3*c* are thin, planar components. However, it can be seen from FIGS. 1 and 2, and will be understood by those skilled in the art, that a certain thickness is necessary to withstand the forces present on the second rotation elements 3*a*, 3*b*, 3*c* during operation. Those skilled in the art will also understand that the shape of the second rotation elements 3*a*, 3*b*, 3*c* must be designed so that a good seal is formed with the first rotation element 1. Each of the second rotation elements 3*a*, 3*b*, 3*c* are driven to rotate at the same angular speed as the first rotation element. Various mechanisms for driving the second rotation elements 3*a*, 3*b*, 3*c* at the same angular speed as the first rotation element are well known to those skilled in the art. For example, the elements may be connected together by gears.

The spark plugs 8*a*, 8*b*, 8*c* are each mounted in the casing 2 at 120° intervals about the first axis 6, intermediate the second rotation elements 3*a*, 3*b*, 3*c*. The spark plugs 8*a*, 8*b*, 8*c* are flush with the casing surface so that they do not protrude into the cavity. Means of operating the spark plugs (not shown) will be known to those skilled in the art.

In use, the first rotation element is rotated about the first axis 6. Referring to FIGS. 1 and 4, as the first rotation element 1 rotates, gases in the form of vaporised fuel and oxygen are drawn into the first rotary engine through the fluid inlet passage 4. The gases are drawn into a working portion of the cavity defined between the sealing segment 1*a* of the first rotation element 1 and second rotation element 3*a*. This working cavity expands as the first rotation element 1 rotates, thus creating a vacuum that draws in the gases.

Figure 2:
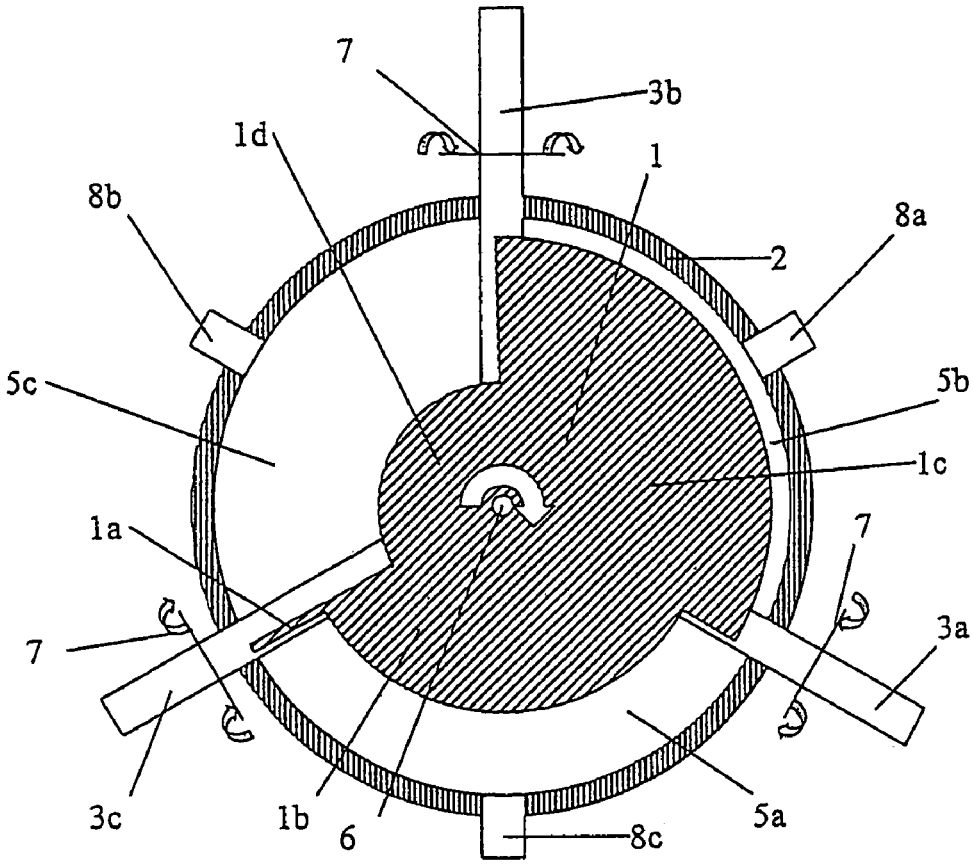

FIG. 2 shows the first rotary engine with the first rotation element 1 advanced by 60° compared to FIG. 1. The sealing segment 1*a* of the first rotation element 1 has now rotated to second rotation element 3*c*. The working portion of the cavity is therefore now defined between second rotation elements 3*a* and 3*c*. The fluid inlet passage 4 is about to rotate past second rotation element 3*c*, thus causing the gases that have been drawn into the rotary engine to be fully enclosed.

Further rotation of the first rotation element 1 causes the combustion segment 1*c* to begin to rotate into the working portion of the cavity defined between second rotation elements 3*a* and 3*c*. The larger radius of the combustion segment 1*c* compared to the compression segment 1*b* causes the volume of the working portion of the cavity to reduce. Since the working portion of the cavity is fully enclosed, the pressure of the gases rises. The pressure of the gases continues to rise until the volume of the working portion of the cavity reaches a minimum. This minimum volume is reached when the combustion segment 1*c* of the first rotation element 1 has fully rotated past second rotation element 3*a*.

At this position, the compressed gases in the working portion of the cavity are ignited by spark plug 8*c*. Combustion of the gases causes a sudden further increase in pressure.

Further rotation of the first rotation element 1 causes the expansion segment 1*d* to begin to rotate into the working portion of the cavity defined between second rotation elements 3*a* and 3*c*. The smaller radius of the expansion segment 1*d* compared to the combustion segment 1*c* causes the volume of the working portion of the cavity to increase. The highly pressurised gases perform work as they expand, thus powering the engine. The gases continue to perform work until the expansion segment 1*d* of the first rotation element 1 has fully rotated past second rotation element 3*a*. Because the compression and expansion segments 1*b*, 1*d* of the first rotation element 1 have different radii, the compression and expansion ratios of the first rotary engine can be different. The invention therefore allows use of the efficient Atkinson-Miller cycle.

Finally, the sealing segment 1*a* begins to rotate into the working portion of the cavity defined between second rotation elements 3*a* and 3*c*. The exhausted gases are forced out through the fluid outlet passage 9 and a new cycle is begun as fresh gases are drawn into the working portion of the cavity through the fluid inlet passage 4.

During operation of the engine, the compression-combustion-expansion cycle described above is also being simultaneously performed in working cavities defined between second rotation elements 3*a* and 3*b*, and 3*b* and 3*c*. Power can be taken from the first rotary engine via a power output shaft (not shown) coupled to the first rotation element 1.

Figure 6:
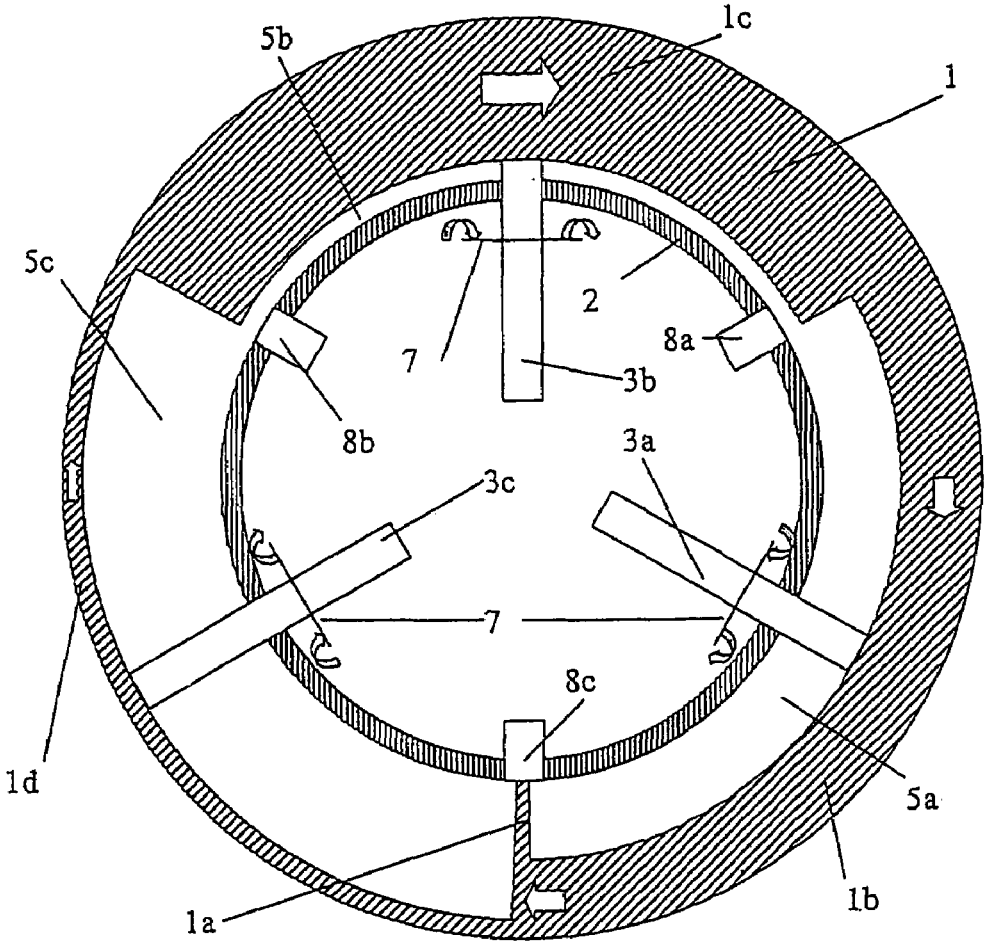
FIG. 6 shows a cross section of a second rotary engine according to the invention.

FIG. 6 shows a second rotary engine according to the invention. In this rotary engine, components performing the same function as those shown in FIGS. 1 to 5 are given the same numerals. The second rotary engine has an annular first rotation element 1 that is mounted external to the casing 2. Three second rotation elements 3*a*, 3*b*, 3*c* are mounted within the casing 2. The second rotary engine operates in the same way as the first rotary engine, with a compression-combustion-expansion cycle being simultaneously performed in working portions of the cavity defined between adjacent second rotation elements.

Figure 7:
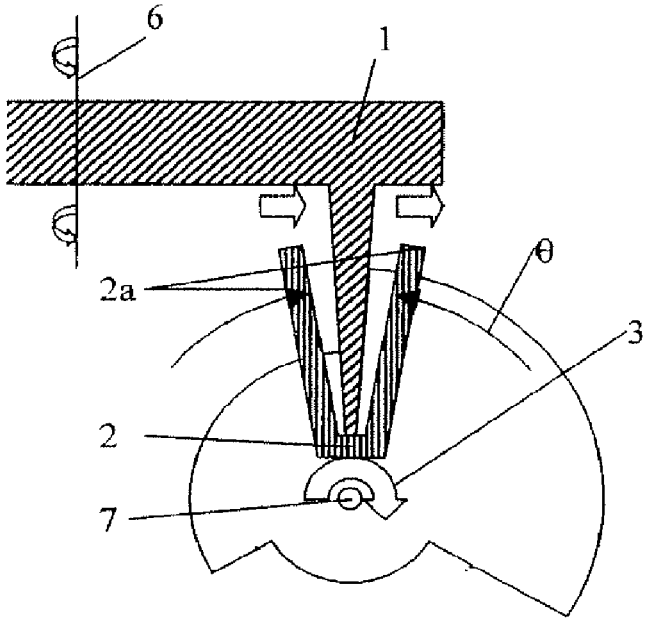
FIG. 7 shows a cross section of a third rotary engine according to the invention.

FIG. 7 shows a third rotary engine according to the invention. In the third rotary engine, the first rotation element 1 is substantially cylindrical. However, the sealing, compression, combustion and expansion segments 1*a*, 1*b*, 1*c*, 1*d* all protrude in a direction parallel to the first axis 6. The casing 2, including the end walls 2*a*, therefore takes the form of an annulus extending around the first axis 6 with a channel shaped cross section. Nevertheless, the third rotary engine operates in a similar way to the first and second rotary engines. Advantageously, the third rotary engine also allows for cooling fins to be integrated into one side of the first rotation element. Other arrangements of the first rotation element will be obvious to those skilled in the art.

In the third rotary engine, the end walls of the casing 2 are non-parallel, being at an angle θ to each other. Angle θ is the angle about the centre of the second rotation element defined by the inner surfaces of the casing end walls 2*a*. In use, when the volume of the working portion of the cavity is at a minimum, a segment of each of the second rotation elements defining the working portion must simultaneously project into the casing by at least the angle θ. In the third rotary engine, which employs three second rotation elements, each of the second rotation elements are out of phase by an angle of 120°. The segment of the second rotation elements corresponding to the combustion segment of the first rotation element must therefore span an angle of 120°+θ.

The end walls 2*a* of the casing 2 shown in FIG. 7 provide a more efficient arrangement than that shown in FIGS. 4 and 5 because angle θ is smaller.

In the rotary engines shown in FIGS. 4, 5 and 7, angle θ must be small so that, once a segment of a second rotation element has rotated into the casing 2 by angle θ to form a seal and define two working portions of the cavity, the seal is maintained until the segment of the first rotation element 1 with which it is co-operating has rotated past. This limits the size of the cavity and thus the power that may be produced by the engine.

Figure 8:
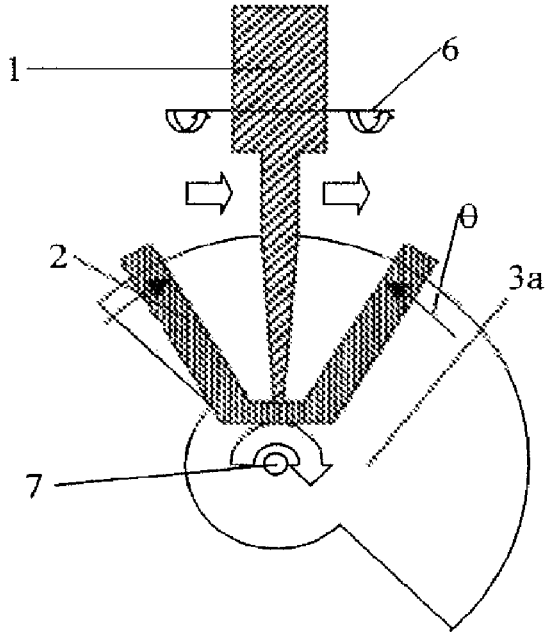
FIGS. 8 and 9 show cross sections of a fourth rotary engine according to the invention.
Figure 9:
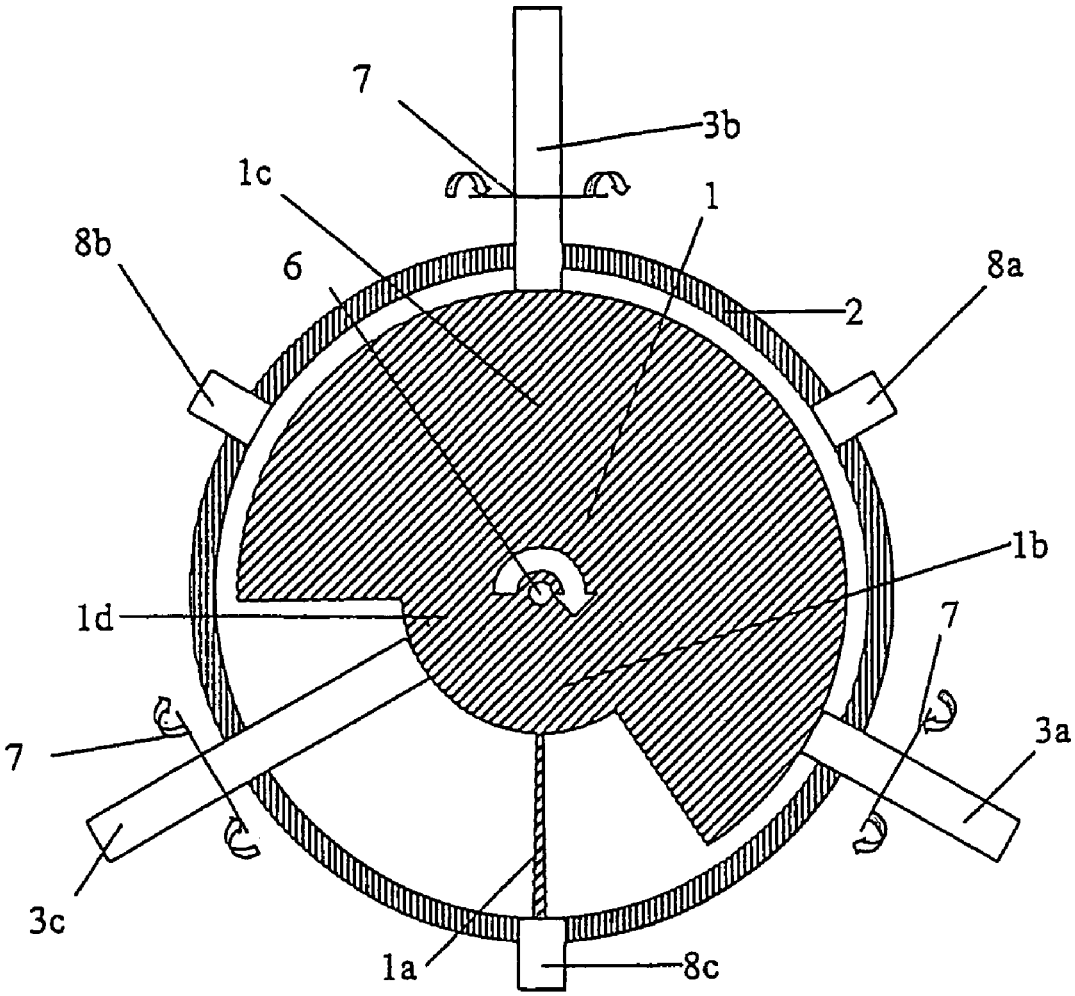

FIGS. 8 and 9 show a fourth rotary engine according to the invention that overcomes the above problem. Angle θ is larger in the fourth rotary engine than in the first to third rotary engines. This increase in angle θ is achieved by modifying the segments that make up the first rotation element 1 and each of the second rotation elements 3*a*, 3*b*, 3*c*. In the fourth rotary engine, the segment of each of the second rotation elements that co-operates with the combustion segment 1*c* of the first rotation element spans an angle of θ+120°. This ensures that a seal is defined between the combustion segment 1*c* of the first rotation element and the relevant second rotation element for a sufficient duration. To accommodate this additional span, the span of the segment of each of the second rotation elements that co-operates with the compression segment 1*b* of the first rotation element 1 is reduced. However, the radius of this segment is increased to compensate for the reduction in span. This is accompanied by a corresponding reduction in span and reduction in radius of the compression segment 1*b* of the first rotation element 1.

When gases are drawn into the fourth rotary engine, they are drawn into a working portion of the cavity that is adjacent to the compression segment 1*b* of the first rotation element 1. Although this segment spans a smaller angle of the first rotation element 1 than in the first to third rotary engines, the volume of the working portion of the cavity immediately prior to compression is similar because the radius of the compression segment 1*b* is smaller, thus giving a greater cross sectional area of the cavity.

FIGS. 10 to 16 show a fifth rotary engine according to the invention. In common with the fourth rotary engine, the radii of the compression segment and the expansion segment of the first rotation element 1 are the same. The compression segment and expansion segment also span different angles.

Figure 10:
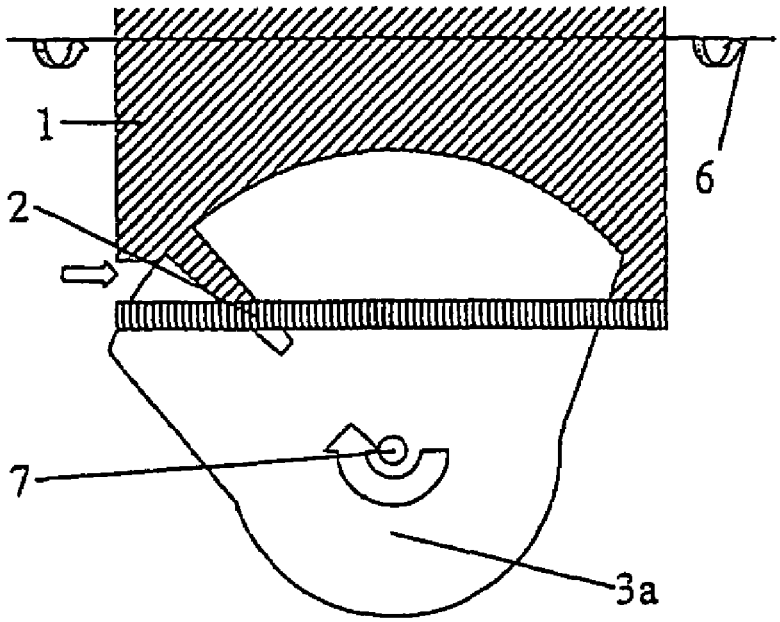
FIGS. 10 to 14 show cross sections of a fifth rotary engine according to the invention in first to fifth positions respectively.

In FIG. 10, the end of the sealing segment of the first rotation element 1 has just rotated past the second rotation element 3*a*, and so gases are starting to be drawn into the working portion of the cavity via the opening near to the segment of the second rotation element 3*a* that co-operates with the compression segment 1*b* of the first rotation element 1.

Figure 11:
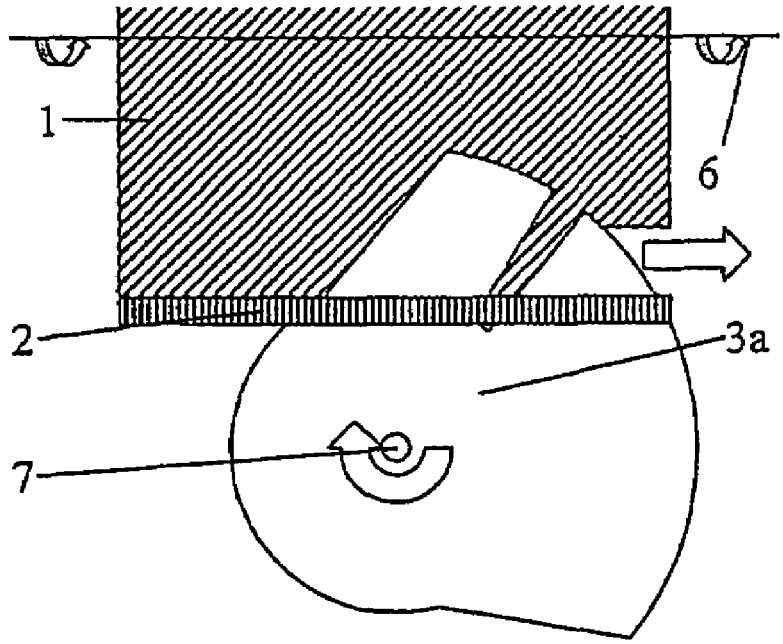

In FIG. 11, the engine has rotated further. Gases are still being drawn into the engine, although this is not shown. The segment of the second rotation element 3*a* that co-operates with the compression segment of the first rotation element 1 has now rotated into the first rotation element, thus forming a seal and defining two working portions of the cavity.

Figure 12:
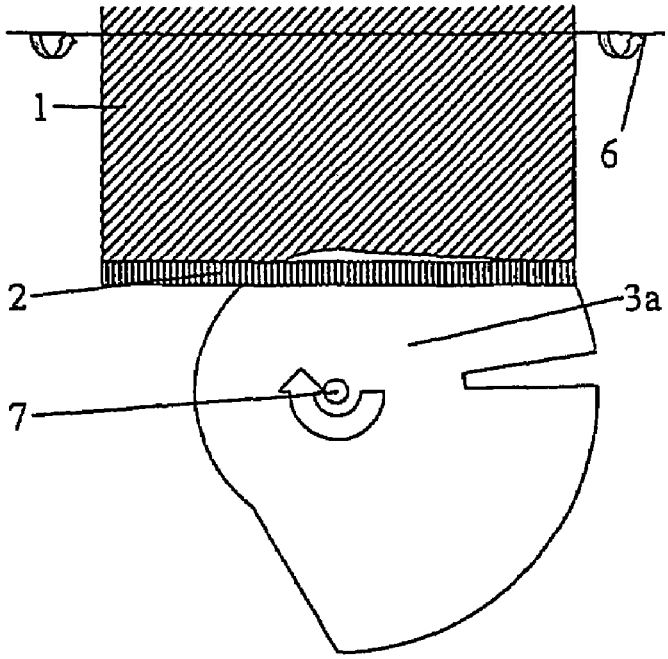

In FIG. 12, the engine has almost rotated to cooperate with the combustion segment of the first rotation element 1.

Figure 13:
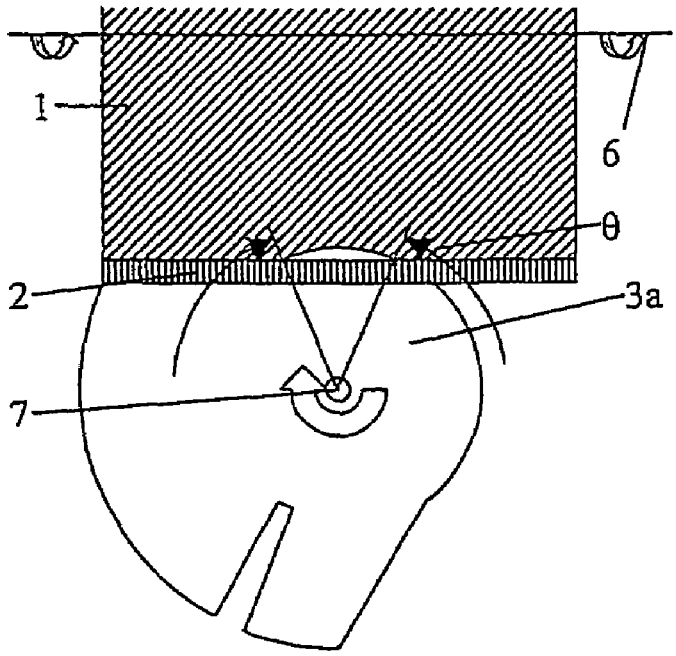

In FIG. 13, the engine has rotated a further 120 degrees. At the other end of the working portion of the cavity, the rotation element is in the position shown in FIG. 12. The gases are now at their maximum compression and combustion occurs.

Figure 14:
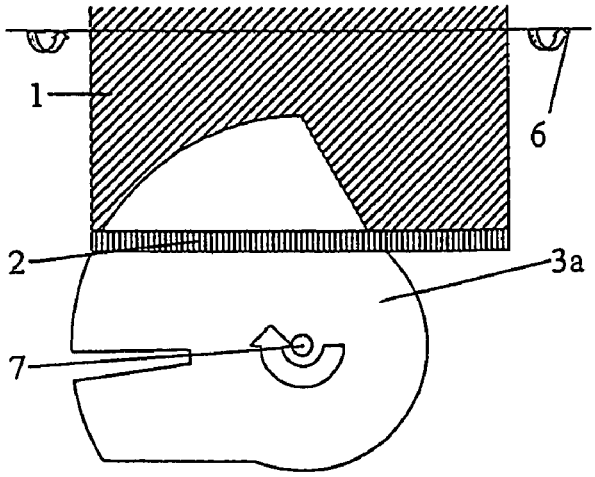

In FIG. 14, the engine has rotated further. The second rotation element 3*a* is now co-operating with the expansion segment of the first rotation element 1. The gases are therefore performing work as they expand.

Further rotation of the engine causes the second rotation element 3*a* to return to the position shown in FIG. 10, at which point the gases are fully expanded. Still further rotation of the engine causes the exhausted gases to be expelled from the engine, as shown in FIG. 11.

Figure 15:
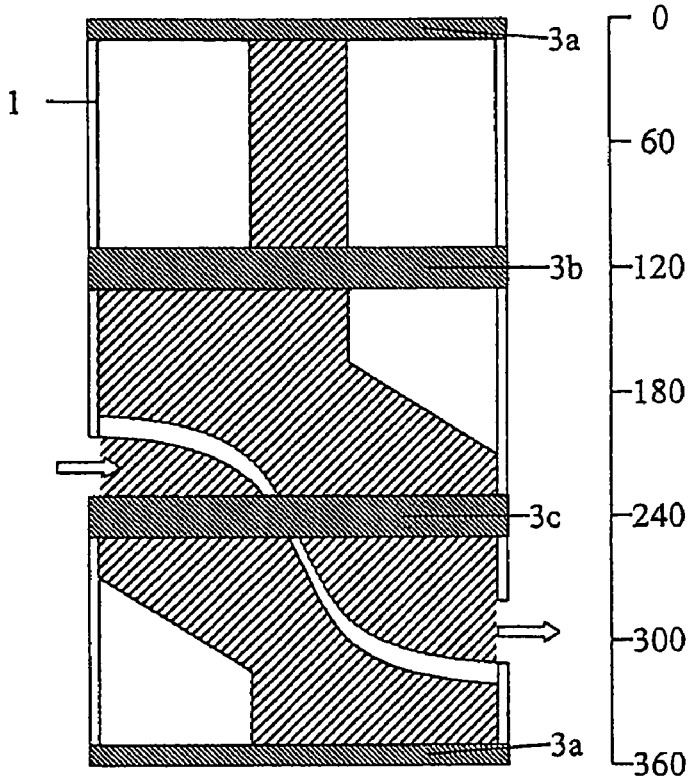
FIGS. 15 and 16 show the surface of the first rotation element of the fifth rotary engine according to the invention in sixth and seventh positions respectively.
Figure 16:
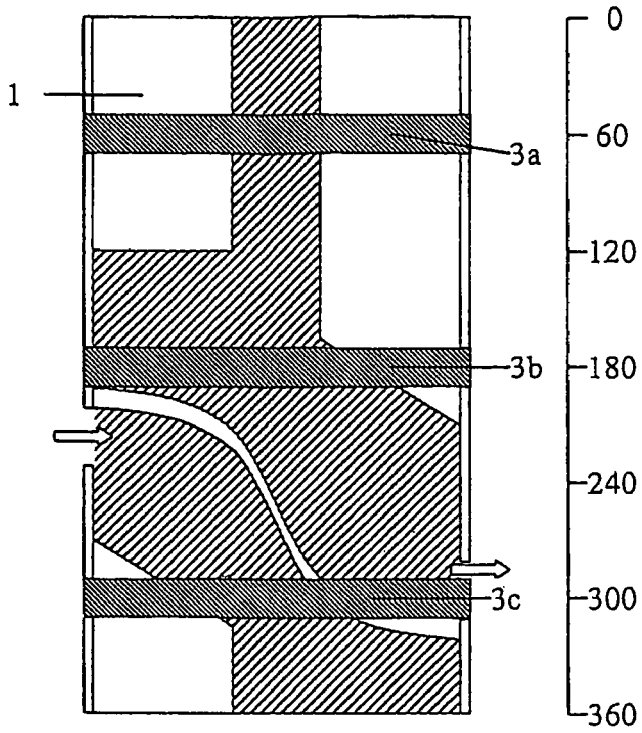

FIGS. 15 and 16 show the surface of the first rotation element 1 of the fifth rotary engine. FIGS. 15 and 16 also show the relative positions of the second rotation elements 3*a*, 3*b*, 3*c*. In FIG. 16, the first rotation element 1 has rotated by 60° compared to FIG. 15. The hatched areas show the surfaces of the first rotation element 1 that define the cavity, and the second rotation elements 3*a*, 3*b*, 3*c*.

Figure 17:
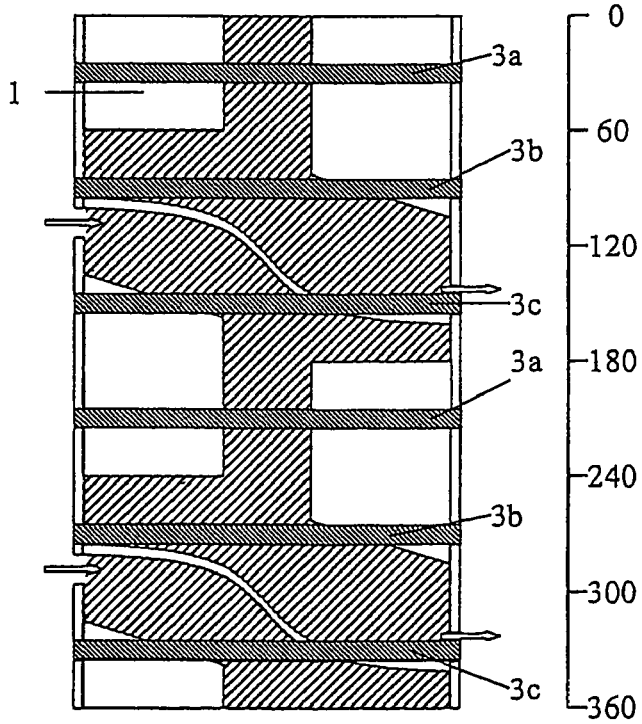
FIG. 17 shows the surface of the first rotation element of a sixth rotary engine according to the invention.

FIG. 17 shows the surface of the first rotation element 1 of a sixth rotary engine according to the invention. FIG. 17 also shows the relative positions of the second rotation elements 3. The sixth rotary engine has six second rotation elements 3 performing the compression-combustion-expansion cycle in six working portions of the chamber. The provision of six second rotation elements 3 allows individual ones of them to be positioned on opposite sides of the first axis 6, thus balancing the forces generated during combustion. This minimises the net forces on the first rotation element 1, and ensures the centre of mass of first rotation element 1 lies on the first axis 6.

Figure 18:
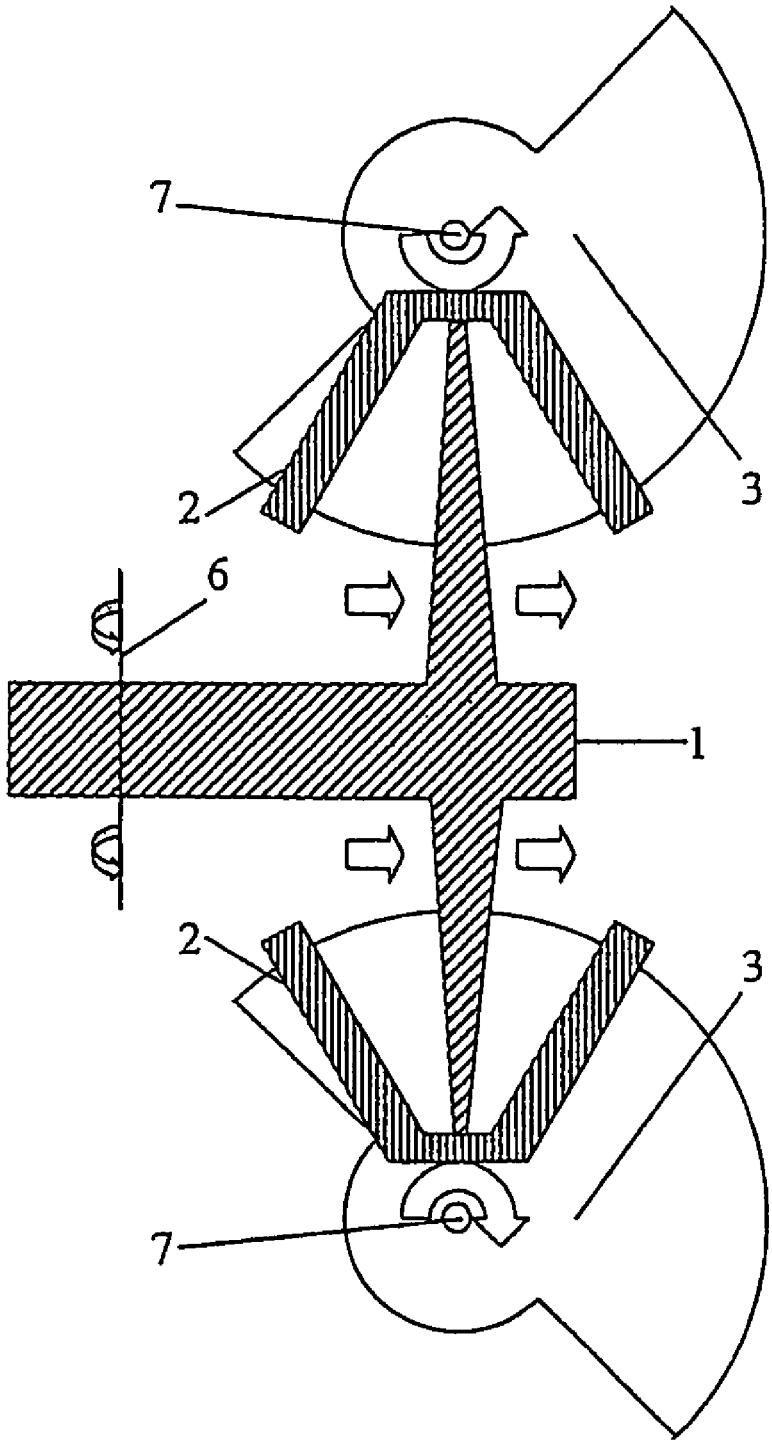
FIG. 18 shows a cross section of a seventh rotary engine according to the invention.
Figure 19:
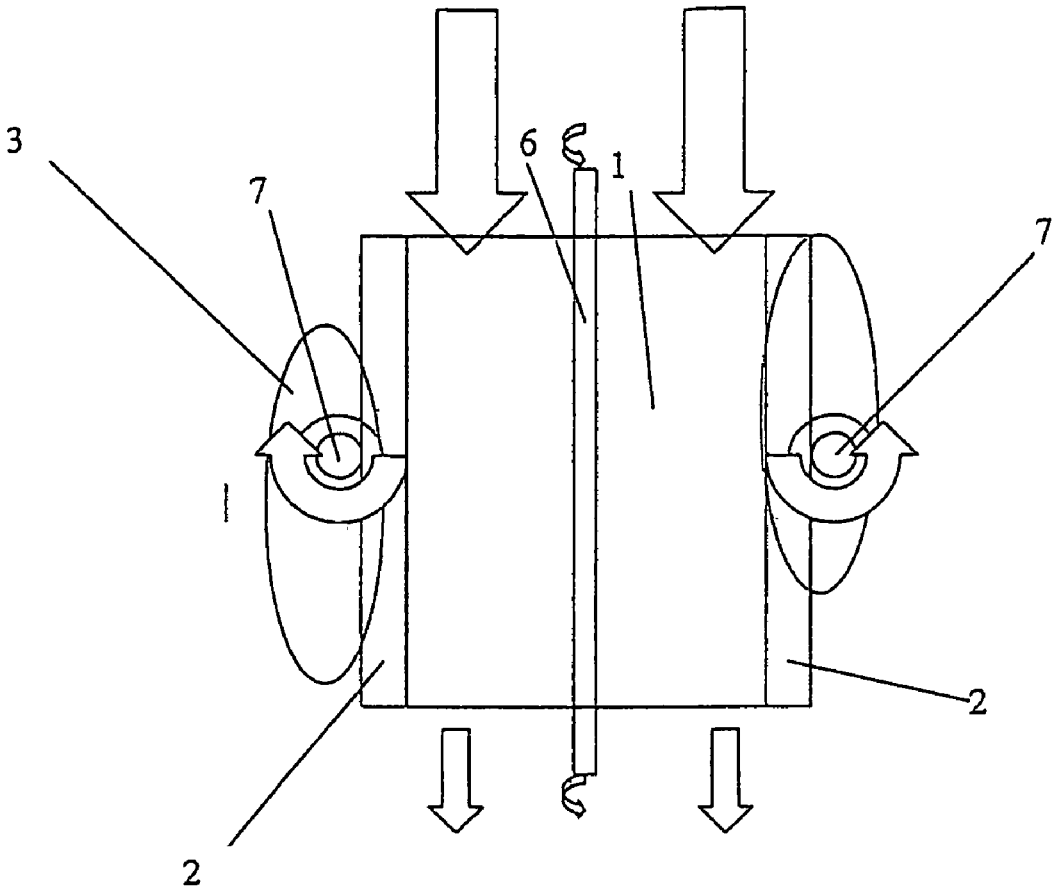
FIG. 19 shows a cross section of an eighth rotary engine according to the invention.

FIG. 18 shows a cross section of a seventh rotary engine according to the invention. The seventh rotary engine also has six second rotation elements 3 performing the compression-combustion-expansion cycle in six working portions of the chamber. Forces generated during combustion are balanced by positioning second rotation elements 3 on opposite sides of the first rotation element 1.

FIGS. 19 to 27 show cross sections of an eighth rotary engine according to the invention. The eighth rotary engine comprises a large number of second rotation elements 3 distributed around the casing 2. Each of the second rotation elements 3 includes two lobes of unequal length. As the second rotation elements 3 rotate, they project into a cavity defined between the first rotation elements 1 and the casing 2. Unlike in the first to seventh rotary engines, the cross sectional area of the cavity varies gradually around the first axis 6.

Figure 20:
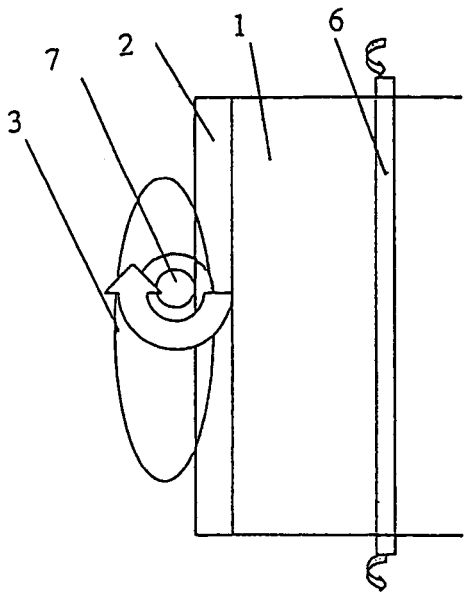
FIGS. 20 to 27 show cross sections of the eighth rotary engine according to the invention in first to eighth positions respectively.

FIGS. 20 to 27 show the eighth rotary engine at various stages of the compression-combustion-expansion process. In FIG. 20, the second rotation element 3 has rotated to a position where it does not project into the first rotation element 1. In this position, a seal is formed between the first rotation element 1 and the casing 2. This seal defines the two ends of the cavity that extends around the first axis 6 and ensures that fresh gases drawn in to the cavity do not mix with exhausted gases.

Figure 21:
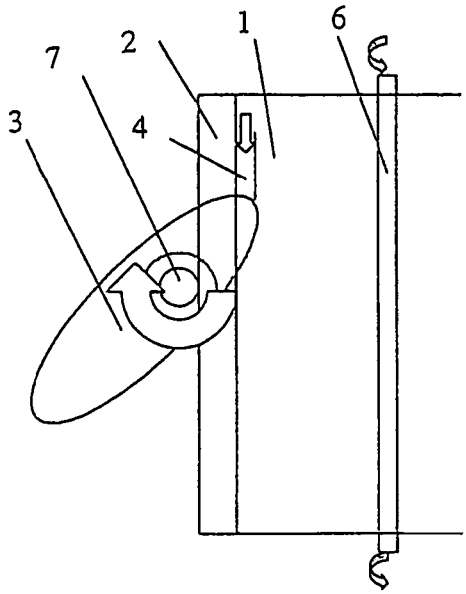

In FIG. 21, the first rotation element 1 has rotated in to the cavity defined between the first rotation element 1 and the casing 2. A working portion of the cavity is now defined between the seal formed by the first rotation element 1 and the casing 2, and the second rotation element 3. Gases are drawn into the working portion of the cavity as it expands through a fluid inlet passage 4, as indicated by the arrow.

Figure 22:
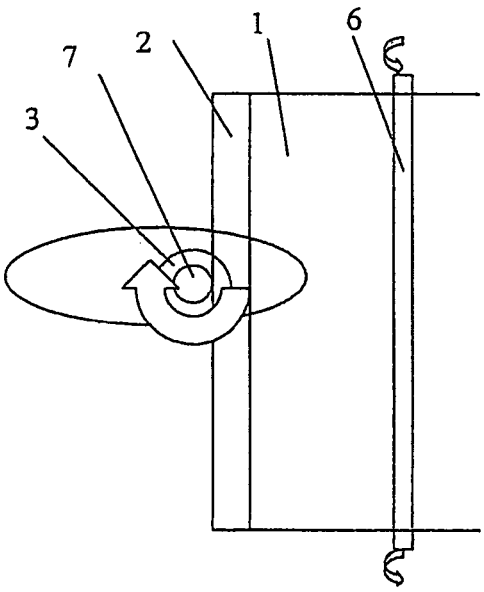

The engine continues to rotate and gases are drawn into the cavity until it the second rotation element 3 has rotated into the position shown in FIG. 22. In this position, the working portion of the cavity is defined between adjacent second rotation elements 3. The fluid inlet passage 4 has rotated away from the working portion of the cavity, which is now fully enclosed.

Figure 23:
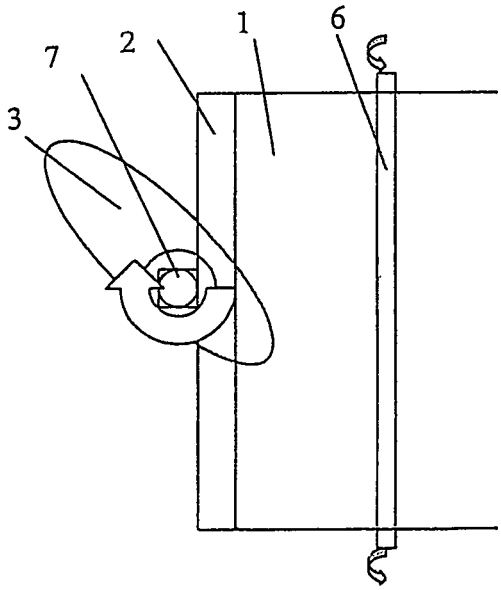

Further rotation of the engine causes the second rotation element to rotate further, as shown in FIG. 23. In this position, the working portion of the cavity has contracted, thus compressing the gases contained therein.

Figure 24:
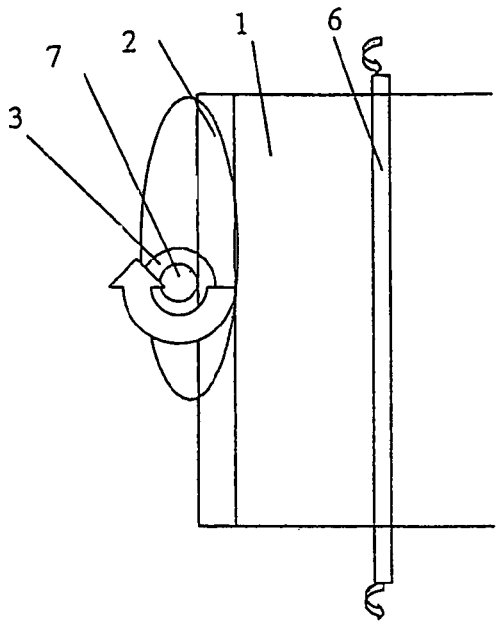

The working portion of the cavity continues to contract until the second rotation element 3 reaches the position shown in FIG. 24. In this position, the volume of the working portion of the cavity is at a minimum and the gases contained therein have been compressed. Combustion of the gases is then induced, thus causing a further increase in the pressure of the gases.

Figure 25:
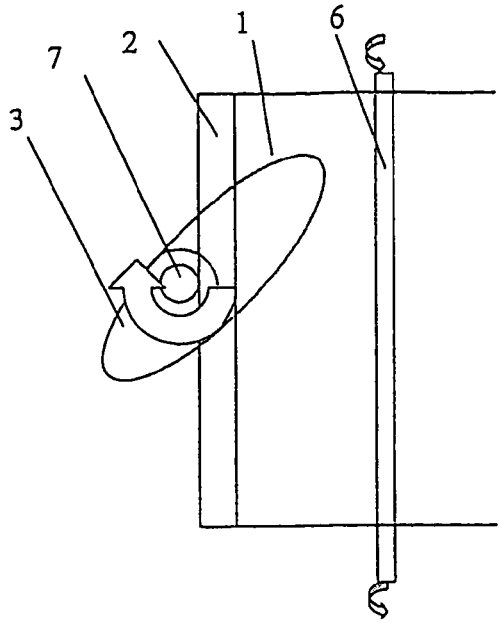

Continued rotation of the engine causes the cavity to expand, as shown in FIG. 25. The gases perform work as they expand, and power is extracted from the engine via a power output shaft (not shown) coupled to the first rotation element.

Figure 26:
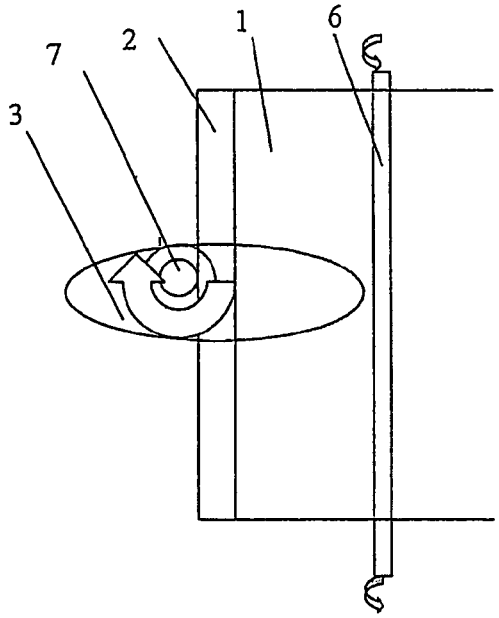

The gases in the working portion of the cavity continue to expand until the second rotation element 3 reaches the position shown in FIG. 26. In this position, the volume of the working portion of the cavity is at a maximum. The cross sectional area of the cavity shown in FIG. 26 is larger than that shown in FIG. 22. The expansion ratio of the engine is therefore larger than its compression ration. Different expansion and compression ratios are possible because each of the second rotation elements 3 include two lobes of different shape. One of the lobes is used during compression and the other is used during expansion.

Figure 27:
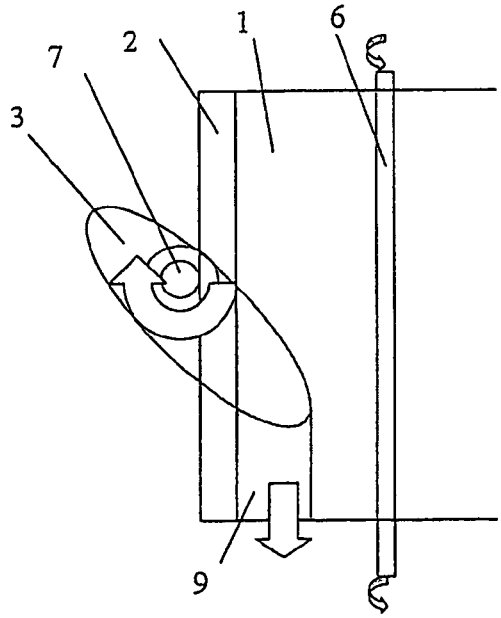

Once the gases have fully expanded, the engine continues to rotate so that the exhausted gases are expelled, as shown in FIG. 27. In this position, the second rotation element 3 has rotated further so that the working portion of the cavity is contracting. The first rotation element 1 has also rotated so that a fluid outlet channel is exposed to the working portion of the cavity. As the working portion of the cavity contracts, the gases contained therein are expelled from the engine through the fluid outlet passage 9, thus completing a cycle of the rotary engine.

Figure 28:
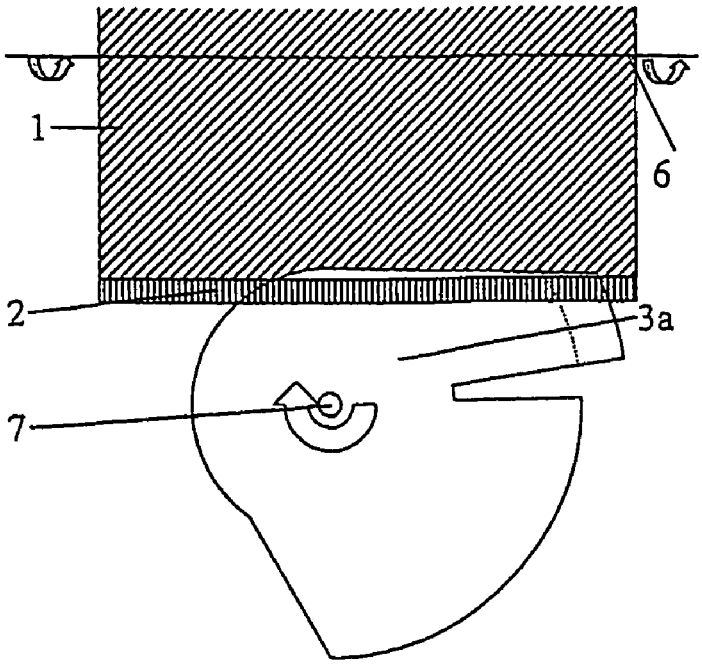
FIGS. 28 and 29 show cross sections of a ninth rotary engine according to the invention in first and second positions respectively.
Figure 29:
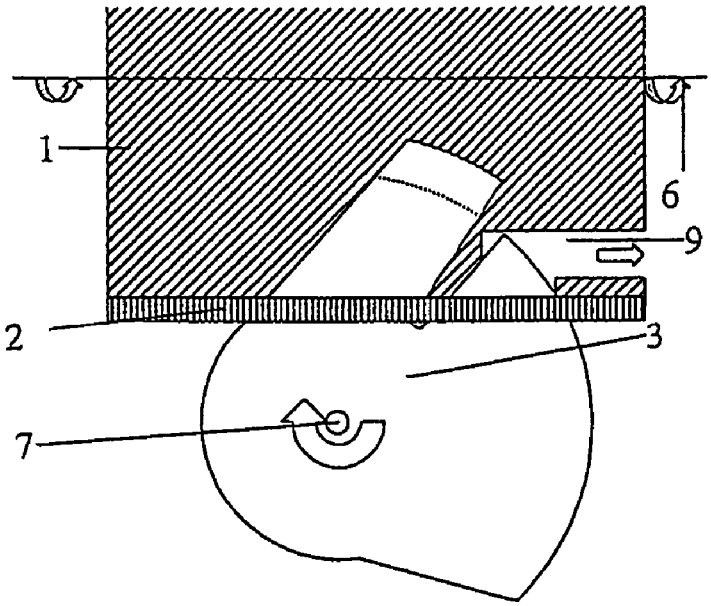
Figure 30:
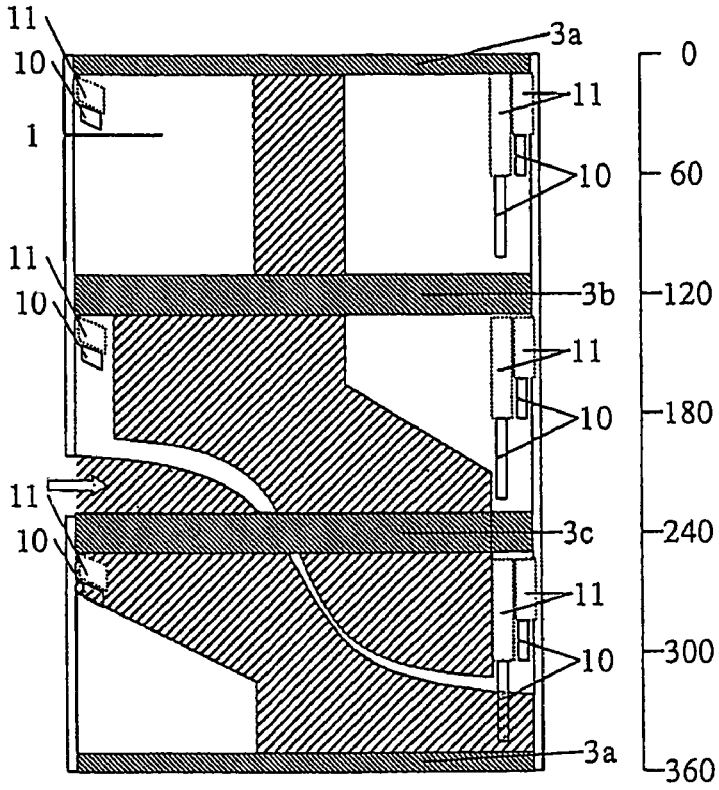
FIG. 30 shows the surface of the first rotation element of the ninth rotary engine according to the invention.

FIGS. 28 to 30 show a ninth rotary engine according to the invention. The ninth rotary engine utilises sliding valves 10 to control its compression ratio. The sliding valves 10 are located in a region of the casing surface that defines the working portion of the cavity during compression of the gases, but not during expansion of the gases. This is achieved by ensuring that the segment of each of the second rotation elements that co-operates with the compression segment of the first rotation element 1 has the largest radius.

In order to prevent exhausted gases from passing through the sliding valves 10, the fluid outlet passage 9 is provided within the first rotation element 1, as shown in FIG. 29. In this respect, the ninth rotary engine is different to other rotary engines according to the invention, for example the fifth engine shown in FIG. 11. The design of the first rotation element 1, as shown in FIG. 29, allows gases to flow between working portions of the cavity defined on opposite sides of the second rotation element 3*a* during expulsion, thus providing an exit route for the gases as the working portion of the cavity contracts.

FIG. 30 shows the surface of the first rotation element 1 of the ninth rotary engine, together with an indication of the relative positions of the second rotation elements 3*a*, 3*b*, 3*c* and the sliding valves 10. Each of the valves 10 has a sliding cover 11. FIG. 30 shows the position of the sliding covers when the sliding valves 10 are fully open.

The sliding valves 10 allow the compression-combustion-expansion cycle of the engine to be modified. In particular, the cycle can be modified so that the some of the compressed gases are vented from the working portion of the cavity prior to combustion, thus reducing the compression ratio of the engine. Preferably, the vented gases will be recycled so as to reduce fuel inefficiency. By altering the extent to which the sliding valves 10 are open, the pressure of the gases, and thus the compression ratio of the engine, can be controlled. In this way, the sliding valves 10 can be used to control the power output of the engine.

The sliding valves 10 are only in use during compression of the gases. Therefore, the sliding valves 10 may remain in the same position throughout the compression-combustion-expansion cycle. The positions of the sliding valves 10 are only modified if a change in the compression ratio of the engine is desired. This principal of operation differs from a conventional combustion engine, in which the valves open and close in every compression-combustion-expansion cycle.

Other valve configurations are possible, and these will be known to those skilled in the art. For example, additional side valves may be provided, the sliding covers of the side valves may slide in different directions to those shown in the figures, and side valves without sliding covers may be provided instead of sliding valves. Valves may form the exclusive fluid inlet for the rotary engine, or else may be provided in combination with one or more fluid inlet passages in the first rotation element 1. Where valves form a fluid inlet to the rotary engine, they may be used to adjust the timing at which gases are no longer drawn into the engine.

Figure 31:
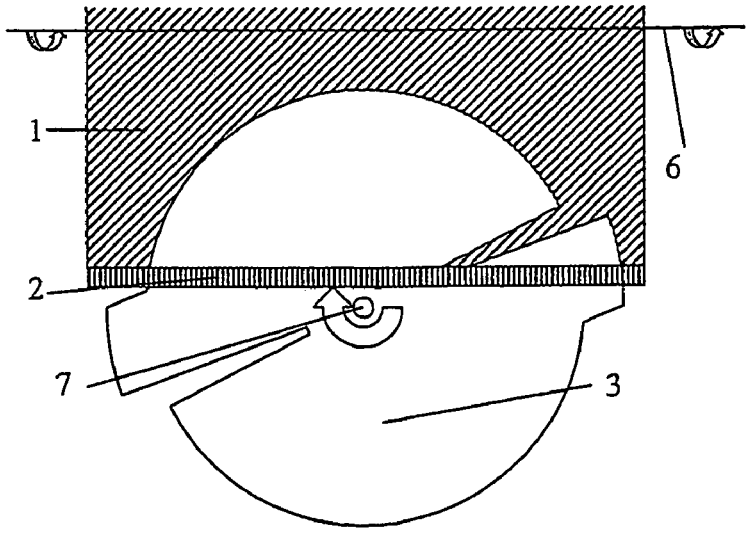
FIG. 31 shows a cross section of a first compressor according to the invention.
Figure 32:
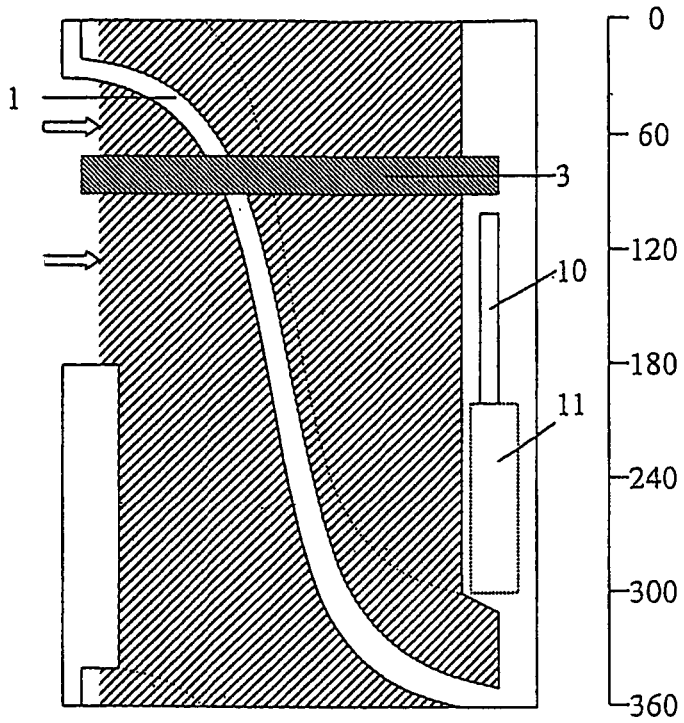
FIGS. 32 and 33 show the surface of the first rotation element of the first compressor according to the invention in first to third positions respectively.
Figure 33:
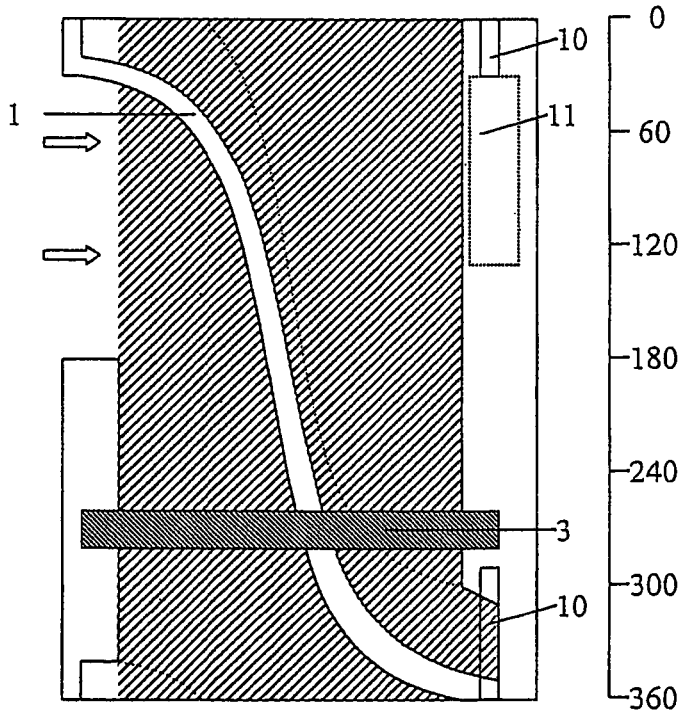

FIGS. 31 to 33 show a first compressor according to the invention. The first compressor operates in a similar way to the rotary engines described above. However, the elimination of combustion and expansion stages from the operating cycle allows simplification. The compressor comprises a single second rotation element 3 that rotates at half the angular velocity of the first rotation element 1. Gases are drawn into the compressor, compressed and then released through a sliding valve 10. The sliding valve 10 can be used to control the extent to which the gases are compressed by the compressor. The first rotation element 1 may be designed so that, during release of the compressed gases, gases may flow between working portions of the cavity defined on opposite sides of the second rotation element 3. This provides an exit route for the gases as the working portion of the cavity contracts.

The compressor may comprise two second rotation elements in order to balance the forces on the first rotation element 1. This may be achieved using the techniques disclosed in FIGS. 17 and 18 and the descriptions thereof.

Figure 34:
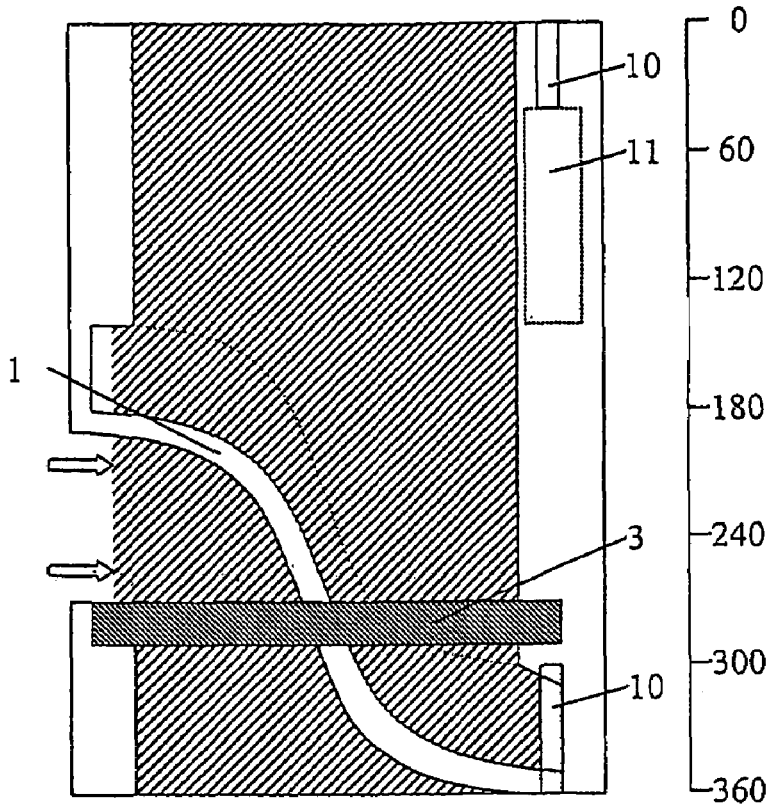
FIG. 34 shows the surface of the first rotation element of a second compressor according to the invention.

FIG. 34 shows a second compressor according to the invention. In this compressor, the volume of the working portion of the cavity is larger than in the first compressor.

Figure 35:
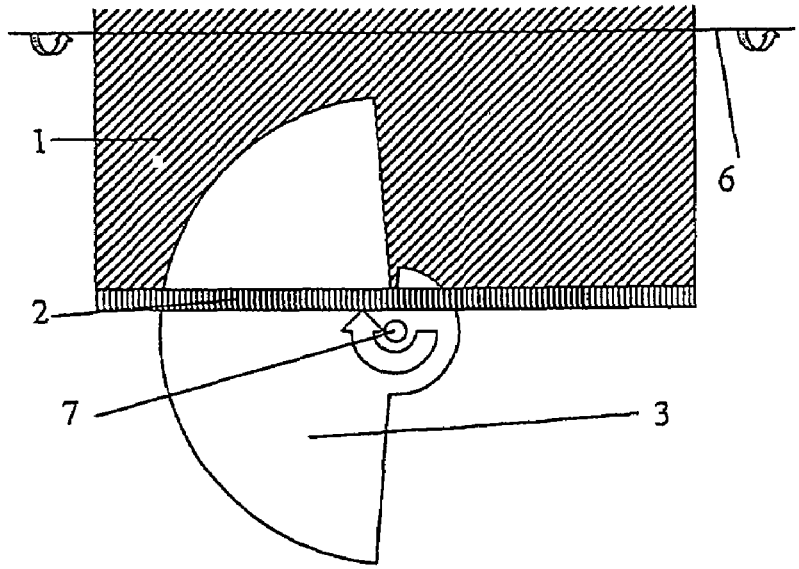
FIG. 35 shows a cross section of a third compressor according to the invention.
Figure 36:
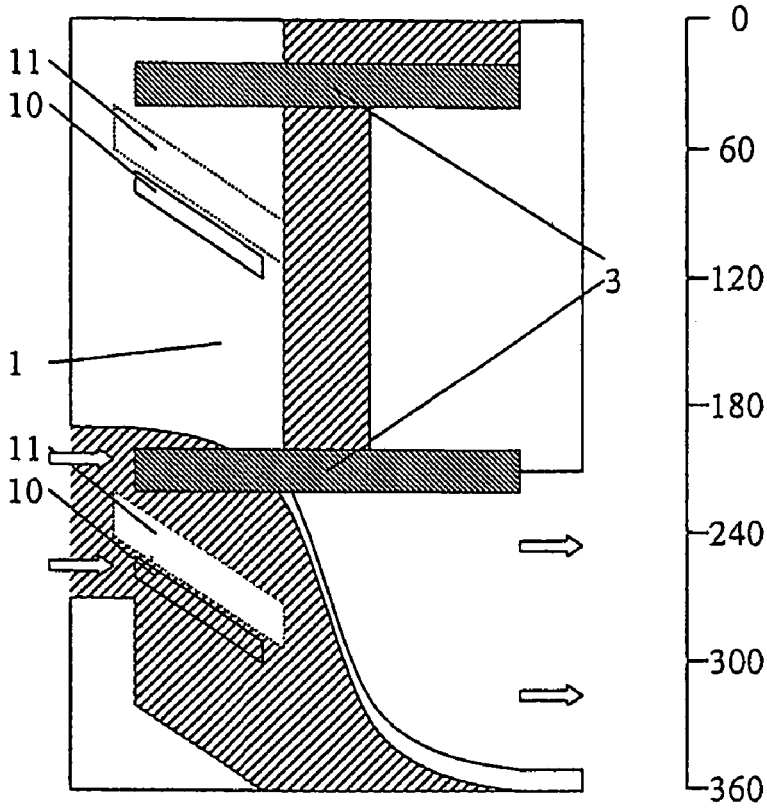
FIG. 36 shows the surface of the first rotation element of the third compressor according to the invention.

FIGS. 35 and 36 show a third compressor according to the invention. In this compressor, sliding valves 10 are used to control the intake of gases rather than their expulsion.

The first, second, and third compressors may operate as expanders. In this case, compressed gases are fed into the fluid outlet and the first and second rotation elements are driven in the opposite directions to those shown in the figures.

Figure 37:
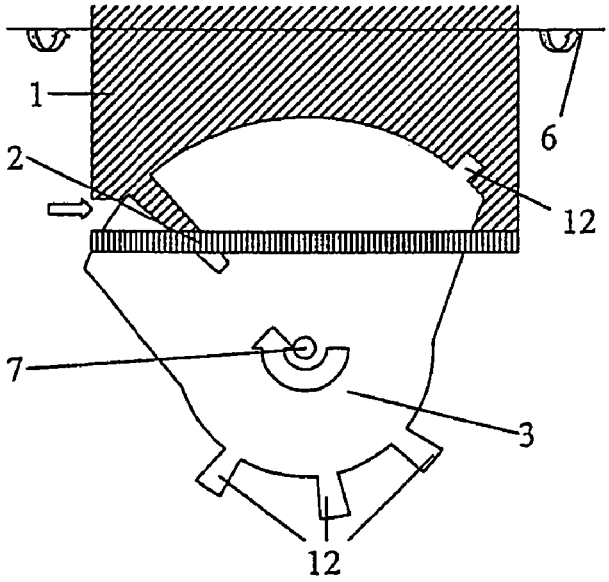
FIG. 37 shows a cross section of a tenth rotary engine according to the invention.

FIG. 37 shows a cross section of a tenth rotary engine according to the invention. In the tenth rotary engine, a number of small teeth 12 have been added to the second rotation elements 3. In this way, the first rotation element 1 may directly drive the second rotation elements 3 at the correct angular velocity. Preferably, the small teeth 12 and the parts of the first rotation element 1 with which they mesh shall have rounded corners.

Figure 38:
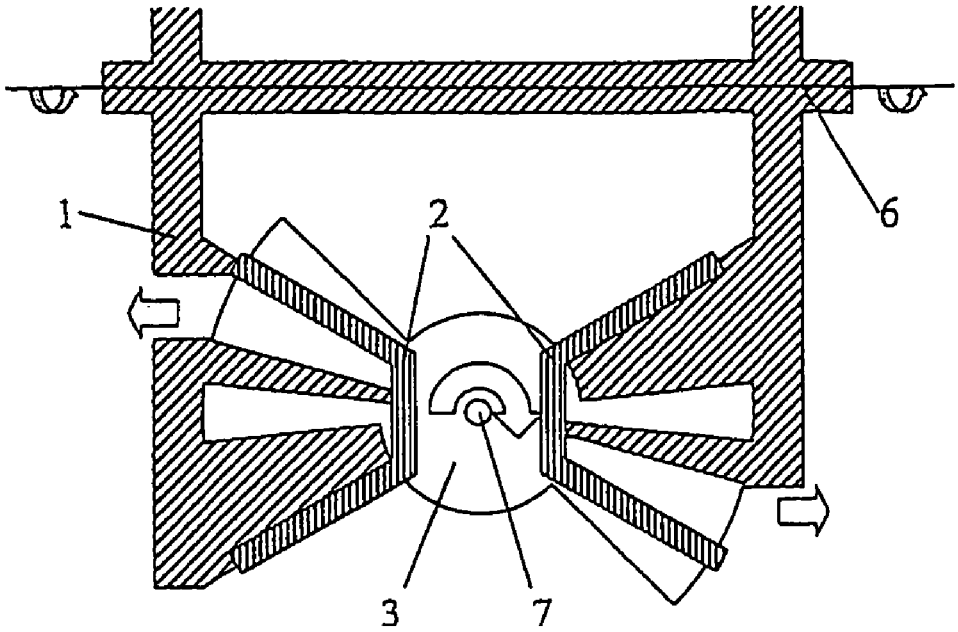
FIGS. 38 and 39 show cross sections of an eleventh and twelfth rotary engine according to the invention respectively.
Figure 39:
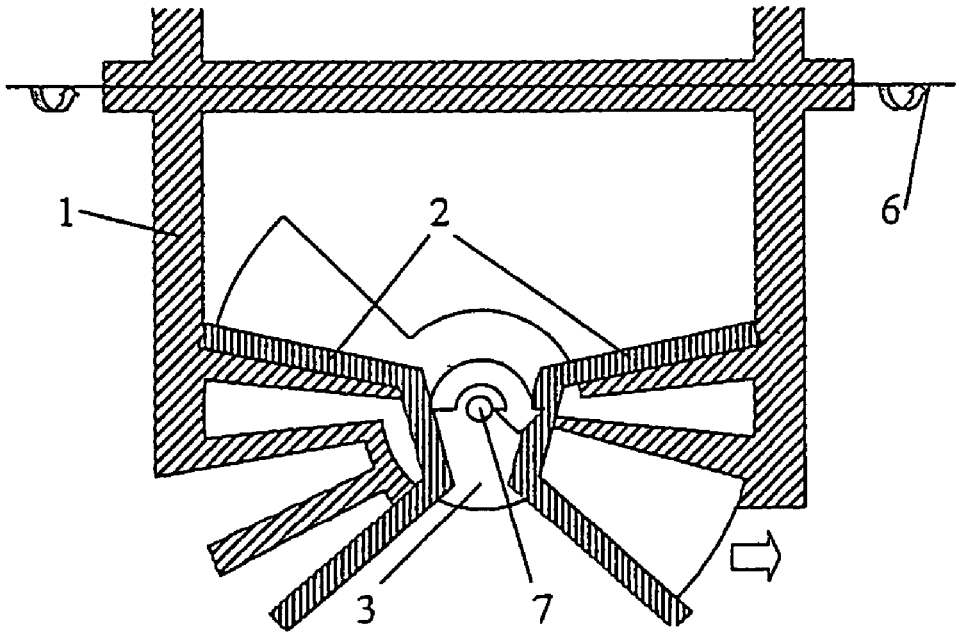

FIGS. 38 and 39 show cross sections of eleventh and twelfth rotary engines according to the invention respectively. The eleventh rotary engine comprises second rotation elements 3 whose centre of gravity is on their axis of rotation. This provides for ease of manufacture and is achieved by providing twice as many segments as are provided in the second rotation elements of the other described rotary inventions. The segments of the second rotation elements 3 span smaller angles than in the other described rotary engines, and thus the cavities volumes of the working portions of the cavity that they define are smaller. However, to some extent this is compensated in the eleventh rotary engine by having cavities on either side of the second rotation element 3. In this way, the eleventh rotary engine may operate as a composite engine.

In the twelfth rotary engine, as shown in FIG. 39, the two cavities are positioned out of phase, thus producing a smoother power output. Excess material has also been removed from the first rotation element 1 of the twelfth rotary engine. This minimises engine weight, minimises the contact area between the first rotation element 1 and the casing 2, and provides enhanced ventilation for the engine.

The shape of the second rotation elements corresponds to the cross sectional shape of the cavity. Since force is proportional to a pressure difference multiplied by area, careful design of the shape of the second rotation elements may provide an engine having a power output that is constant over an entire revolution. For an engine having a single cavity, the area of the first rotation element on which work is performed is the difference between the area of second rotation elements that define each end of the cavity. The volume and thus pressure of gases within a cavity may be calculated. This pressure and volume allow calculation of the available energy as a function of the rotation of the first rotation element, thus allowing calculation of the torque of the engine.

The torque from each cavity may be found. A shape for the second rotation elements may then be found that provides an engine having a smooth torque output.

The shape of the second rotation elements may be specified by radius as a function of the angle. Specifying a goal such as "maximise the minimum torque" allows computational methods that will be known to those skilled in the art to be used to find a shape of second rotation element that provides an engine having a smooth power output.

Figure 40:
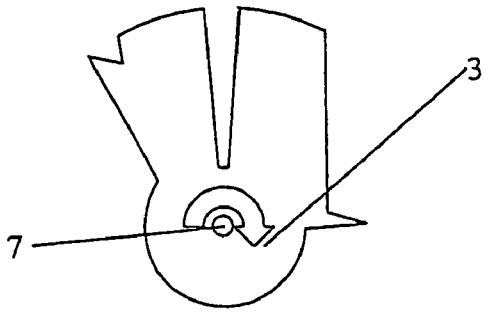
FIG. 40 shows a side profile of a second rotation element of a thirteenth rotary engine according to the invention.

FIG. 40 shows an example of a shape of second rotation element 3 that may be used to provide an engine having smooth power output. The spike at the top left of the second rotation element 3*a* reduces the area that performs compression of the gases when pressure is high. Similarly, the spike at the bottom right of the second rotation element 3*a* allows a gradual expansion of gases when the pressure is high, and a rapid expansion of gases when the pressure is lower, thus providing an engine having a steady power output.

Figure 41:
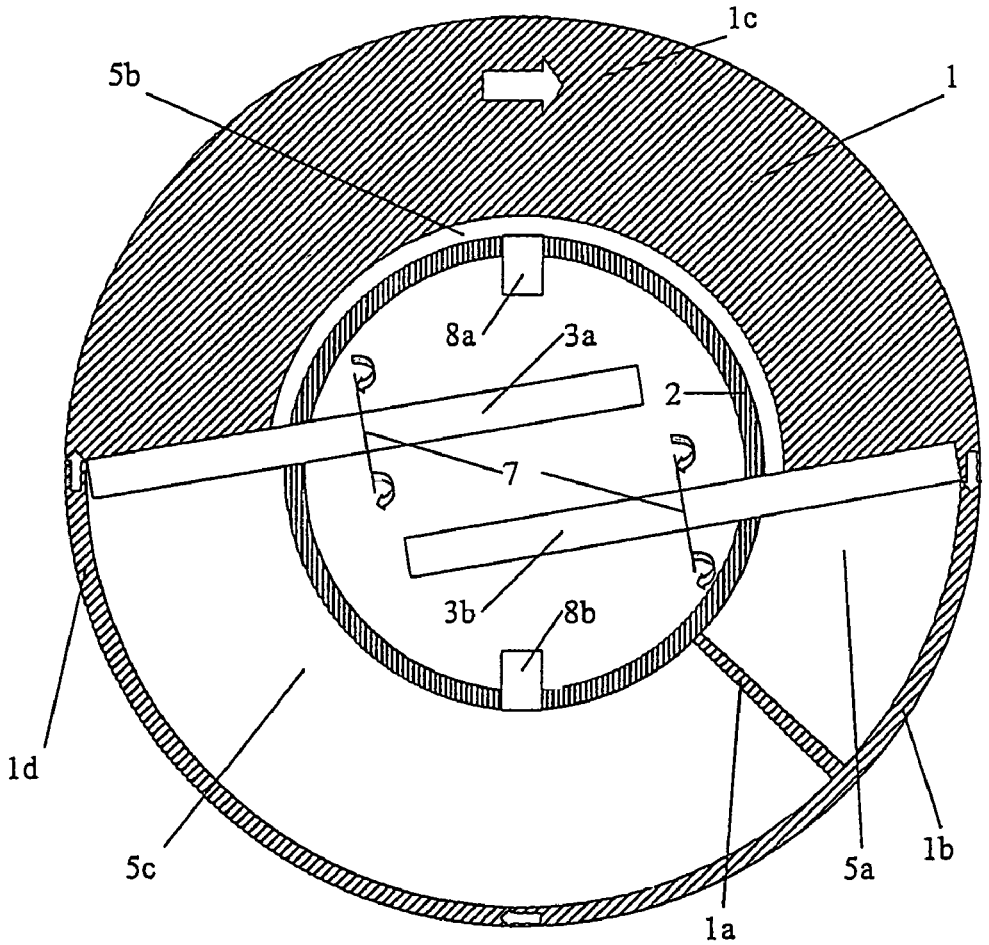
FIG. 41 shows a cross section of a fourteenth rotary engine according to the invention.

FIG. 41 shows a cross section of a fourteenth rotary engine according to the invention. The fourteenth rotary engine has an annular first rotation element 1 that is mounted external to the casing 2. Two second rotation elements 3*a*, 3*b* are mounted within the casing 2. In the fourteenth rotary engine, these elements have been mounted so that the plane of the second rotation elements does not intersect the axis of the first rotation element. This allows the second rotation elements to have a maximum radius greater than the inner radius of the casing, allowing a larger working volume for a given engine radius. Also, this engine has a relatively low casing radius compared to the outer radius of the first rotation element. This gives a relatively low area for friction between the first rotation element and the casing, and a relatively small length for leakage between the casing and the first rotation element. This configuration also provides these benefits for compressors and expanders.

FIGS. 42 to 46 illustrate some of the characteristics of the device according to the invention that distinguish it from known rotary devices. It is noted that the parts shown in these figures have already been described with reference to earlier figures, and that FIGS. 42 to 46 do not add additional knowledge required for building the engine or understanding its operation.

Figure 42:
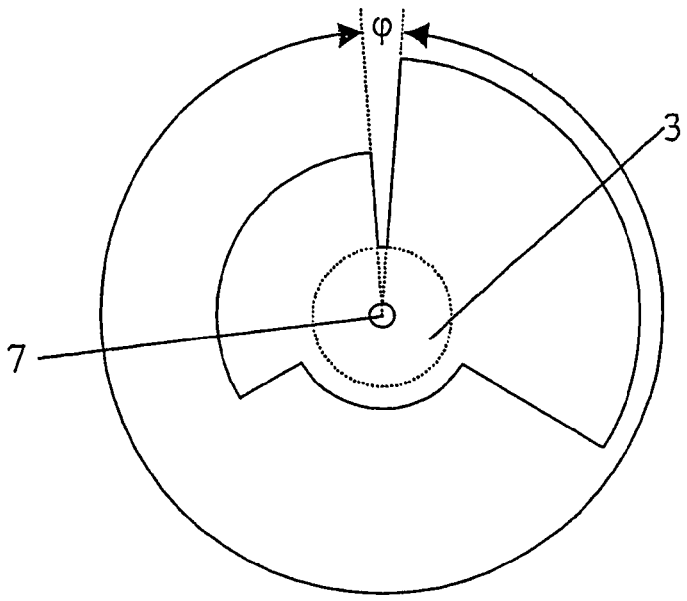
FIGS. 42, 43, 44 and 45 illustrate characteristics of the second rotation elements shown in FIGS. 1 to 41.
Figure 43:
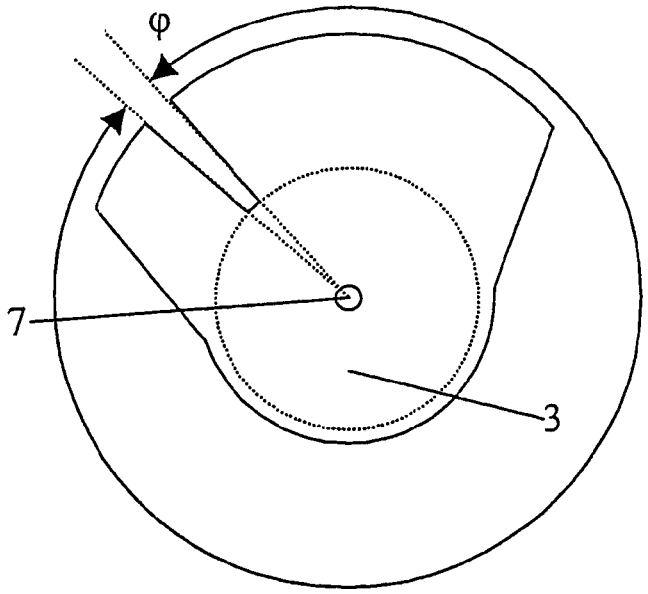
Figure 44:
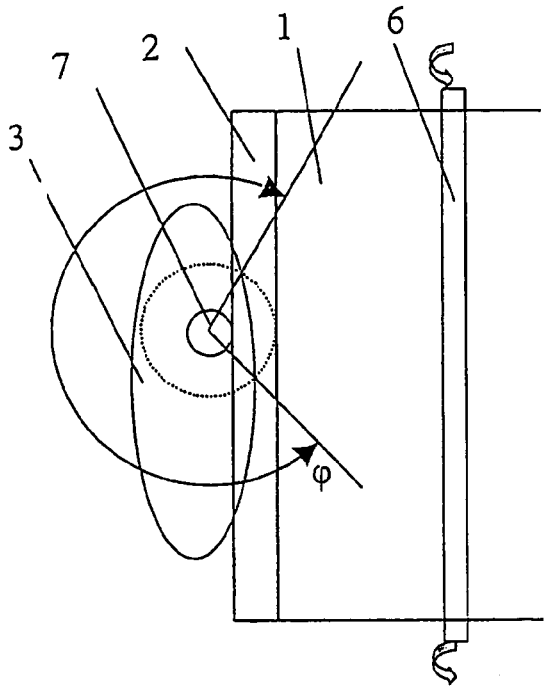
Figure 45:
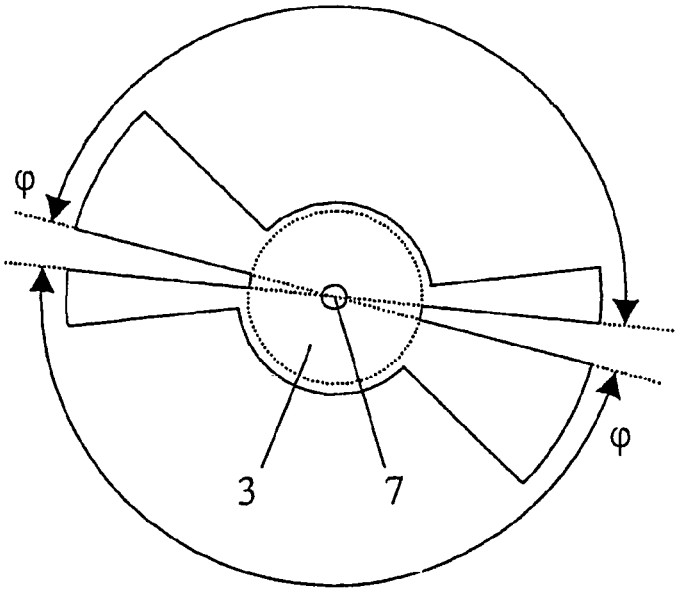
Figure 46:
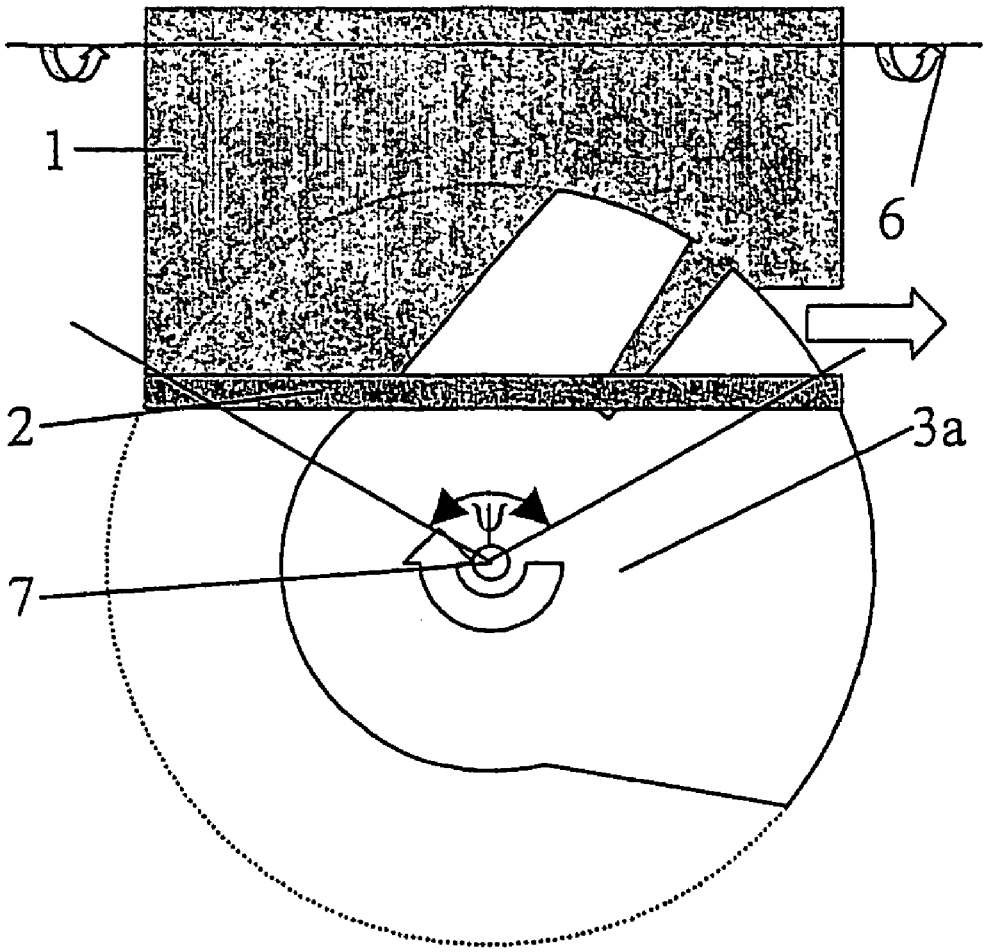
FIG. 46 illustrates characteristics of devices shown in FIGS. 1 to 41.

FIGS. 42 to 44 illustrate second rotation elements 3 that may be viewed as having one large tooth, or protruding portion. FIG. 45 illustrates a second rotation element that may be viewed as having two large teeth, or protruding portions. The teeth, or protruding portions, are the parts of the second rotation element that protrude into the cavity defined by the casing and the first rotation element at some part of the cycle. The teeth define a "tooth-angle", $\phi$, measured around the axis of the rotation element 3. Typically, the second rotation element is designed so that the tooth angle is just less than 360°/t, where t is the number of teeth. In FIGS. 42 and 43, the tooth-angle $\phi$ is just under 360°. In FIG. 45, the tooth-angle is just under 180°. FIG. 46 illustrates that the casing 2 may be viewed as having a slot-angle, $\psi$, measured around the axis of the first rotation element 3, and defined by the region where the second rotation element may project into the cavity. In the most natural embodiments of the device, the tooth-angle $\phi$ is larger than the slot angle $\psi$.

The above embodiments of the invention described with reference the figures are purely preferred embodiments, and are described by way of example only. It will be apparent to those skilled in the art that there are many other embodiments of the invention not described, and the scope of the invention is defined by the claims.

The invention claimed is:

1. A rotary engine for use with compressible fluids, the engine comprising:

a first rotation element mounted to rotate about a first axis;

a casing having a surface enclosing at least a part of the first rotation element, an elongate cavity of varying cross sectional area being defined between a surface of the first rotation element and the casing surface; and a plurality of second rotation elements mounted to rotate about respective different second axes, each second rotation element being mounted to project through a slot in the casing surface and to cooperate with the first rotation element surface so as to divide the cavity into adjacent working portions, wherein each second rotation element comprises a plurality of projecting portions having respective different radii about the second axis, the different radii causing the projecting portions to project into the cavity by respective different amounts, so that the volumes of the working portions vary as the first and second rotation elements rotate, wherein, during a cycle of an engine operation, fluid in a working portion undergoes compression, combustion and expansion as a closed volume, the closed volume being defined during the compression, combustion and expansion by an adjacent pair of second rotation elements.

2. The engine of claim 1, wherein each projecting portion of a second rotation element spans an angle about the respective second axis, the radius of the projecting portion constantly varying about the axis.

3. The engine of claim 1, wherein each projecting portion of a second rotation element spans an angle about the respective second axis, the radius of the projecting portion stepping about the axis.

4. The engine of claim 3, wherein a number of the projecting portions of each second rotation element only partially project through a respective slot at any time during rotation of the first and second rotation elements.

5. The engine of claim 4, wherein a maximum angle spanned by a slot about a respective second axis is smaller that the angle spanned by a number of the projecting portions of each second rotation element.

6. The engine of any one of the preceding claims, wherein the first rotation element surface is a cylindrical surface.

7. The engine of claim 6, wherein the first rotation element is internal to the casing surface and the second rotation elements are external to the casing surface.

8. The engine of claim 6, wherein the first rotation element is external to the casing surface and the plurality of second rotation elements are internal to the casing surface.

9. The engine of claim 1, wherein the first rotation surface is an end surface.

10. The engine of claim 1, further comprising ignition means for ignition of a compressed fluid prior to expansion.

11. The engine of claim 1, wherein the second rotation elements are distributed about the first rotation element, each second rotation element being mounted to rotate about a respective second axis that is perpendicular to the first axis.

12. The engine of claim 1, wherein the first rotation element surface and the casing surface further define a seal between working portions of the cavity.

13. The engine of claim 1, wherein, during a cycle of an engine operation, fluid in a working portion undergoes the compression, combustion and expansion within one rotation of the first rotation element.

* * * * *